US009732694B2

(12) United States Patent
Mori et al.

(10) Patent No.: US 9,732,694 B2
(45) Date of Patent: Aug. 15, 2017

(54) FUEL SUPPLY DEVICE

(71) Applicant: DENSO CORPORATION, Kariya, Aichi-pref. (JP)

(72) Inventors: Hideyuki Mori, Chiryu (JP); Nobuyuki Satake, Kariya (JP)

(73) Assignee: DENSO CORPORATION, Kariya (JP)

( * ) Notice: Subject to any disclaimer, the term of this patent is extended or adjusted under 35 U.S.C. 154(b) by 175 days.

(21) Appl. No.: 14/434,838

(22) PCT Filed: Oct. 9, 2013

(86) PCT No.: PCT/JP2013/006004
§ 371 (c)(1),
(2) Date: Apr. 10, 2015

(87) PCT Pub. No.: WO2014/061233
PCT Pub. Date: Apr. 24, 2014

(65) Prior Publication Data

US 2015/0275812 A1 Oct. 1, 2015

(30) Foreign Application Priority Data

Oct. 15, 2012 (JP) ..... 2012-228150
Aug. 8, 2013 (JP) ..... 2013-165090

(51) Int. Cl.
*F02D 41/30* (2006.01)
*F02M 37/08* (2006.01)
(Continued)

(52) U.S. Cl.
CPC ..... *F02D 41/3082* (2013.01); *F02D 33/003* (2013.01); *F02D 41/20* (2013.01);
(Continued)

(58) Field of Classification Search
CPC ..... F02D 2041/2051; F02D 2250/31; F02D 33/003; F02D 41/3082; F02M 37/0052; F02M 37/08; F02C 9/30
See application file for complete search history.

(56) References Cited

U.S. PATENT DOCUMENTS 5,353,759 A * 10/1994 Abe ..... F01M 5/04 123/179.15
5,411,002 A 5/1995 Smitley
(Continued)

FOREIGN PATENT DOCUMENTS

| | | |
|---|---|---|
| JP | 8-232737 | 9/1996 |
| JP | 11-247705 | 9/1999 |
| JP | 3650522 | 2/2005 |

OTHER PUBLICATIONS

Abramowitz, M. and Stegun, I. A. (Eds.). Handbook of Mathematical Functions with Formulas, Graphs, and Mathematical Tables, 9th printing. New York: Dover, p. 14, 1972.*
(Continued)

*Primary Examiner* — Sizo Vilakazi
*Assistant Examiner* — Kevin R Steckbauer
(74) *Attorney, Agent, or Firm* — Nixon & Vanderhye PC

(57) ABSTRACT

A fuel supply device (1) has a valve (13) in a fuel passage between a fuel pump (3) and an engine (5). In a storage portion of an ECU (18-21) is stored a relationship between a fuel pressure and a flow rate, which are required by the engine, and voltage which is supplied to a motor (7). The ECU senses voltages V26, V27, V28 supplied to the motor from a controller (22) when the valve is opened from change points C1', C2', C3' at which a characteristic between the voltage and the current which are supplied to the motor (7) is changed. Then, the ECU corrects the voltage stored in the storage portion on the basis of differences between voltages V1, V2, V5 stored in the storage portion at the change points
(Continued)

C1, C2, C3 and the voltages V26, V27, V28 when the valve is opened. In this way, the fuel supply device can correctly control the motor in correspondence to the fuel pressure and the flow rate which are required by the engine.

15 Claims, 22 Drawing Sheets

(51) Int. Cl.

| | |
|---|---|
| ***F02D 41/24*** | (2006.01) |
| ***F02M 37/00*** | (2006.01) |
| ***F02D 33/00*** | (2006.01) |
| *F02M 37/10* | (2006.01) |
| *F02M 69/00* | (2006.01) |
| *F02D 41/20* | (2006.01) |

(52) U.S. Cl.
CPC ..... *F02D 41/2464* (2013.01); *F02M 37/0052* (2013.01); *F02M 37/08* (2013.01); *F02D 2041/2051* (2013.01); *F02D 2250/31* (2013.01); *F02M 37/106* (2013.01); *F02M 69/00* (2013.01)

(56) References Cited

U.S. PATENT DOCUMENTS

| | | | | |
|---|---|---|---|---|
| 5,715,797 | A | 2/1998 | Minagawa et al. | |
| 5,842,454 | A | 12/1998 | Miwa et al. | |
| 7,762,080 | B2 * | 7/2010 | Anson | F02C 7/22 417/44.11 |
| 2010/0115959 | A1 * | 5/2010 | Anson | F02C 9/30 60/772 |
| 2010/0274467 | A1 * | 10/2010 | Hayami | F02D 41/2438 701/103 |
| 2012/0156057 | A1 | 6/2012 | Akita | |
| 2014/0373508 | A1 * | 12/2014 | van Vuuren | F01N 3/208 60/274 |
| 2016/0237937 | A1 * | 8/2016 | Kusakabe | F02D 41/20 |
| 2016/0245211 | A1 * | 8/2016 | Katsurahara | F02D 41/20 |
| 2016/0252035 | A1 * | 9/2016 | Katsurahara | F02D 41/20 |
| 2016/0252037 | A1 * | 9/2016 | Katsurahara | F02D 41/20 123/480 |

OTHER PUBLICATIONS

International Search Report for PCT/JP2013/006004 mailed Dec. 10, 2013, 7 pages.
Written Opinion of the International Searching Authority for PCT/JP2013/006004, mailed Dec. 10, 2013, 4 pages.

* cited by examiner

| | | Q (L/h) | | | | | |
|---|---|---|---|---|---|---|---|
| | | 0 | Q1 | Q2 | ··· | Q3 | Q4 |
| P (kPa) | P1 | $V_1$ | $V_6$ | $V_{11}$ | ··· | $V_{16}$ | $V_{21}$ |
| | P2 | $V_2$ | $V_7$ | $V_{12}$ | ··· | $V_{17}$ | $V_{22}$ |
| | P3 | $V_3$ | $V_8$ | $V_{13}$ | ··· | $V_{18}$ | $V_{23}$ |
| | P4 | $V_4$ | $V_9$ | $V_{14}$ | ··· | $V_{19}$ | $V_{24}$ |
| | P5 | $V_5$ | $V_{10}$ | $V_{15}$ | ··· | $V_{20}$ | $V_{25}$ |

FIG. 5

| | | Q (L/h) | | | | | |
|---|---|---|---|---|---|---|---|
| | | 0 | Q1 | Q2 | ··· | Q3 | Q4 |
| P (kPa) | P1 | $V_{26}$ | $V_{29}$ | $V_{34}$ | ··· | $V_{39}$ | $V_{44}$ |
| | P2 | $V_{27}$ | $V_{30}$ | $V_{35}$ | ··· | $V_{40}$ | $V_{45}$ |
| | P3 | ⇕ | $V_{31}$ | $V_{36}$ | ··· | $V_{41}$ | $V_{46}$ |
| | P4 | | $V_{32}$ | $V_{37}$ | ··· | $V_{42}$ | $V_{47}$ |
| | P5 | $V_{28}$ | $V_{33}$ | $V_{38}$ | ··· | $V_{43}$ | $V_{48}$ |

| | | Q(L/h) | | | | | |
|---|---|---|---|---|---|---|---|
| | | 0 | Q1 | Q2 | ··· | Q3 | Q4 |
| P(kPa) | P1 | $I_1$ | $I_6$ | $I_{11}$ | ··· | $I_{16}$ | $I_{21}$ |
| | P2 | $I_2$ | $I_7$ | $I_{12}$ | ··· | $I_{17}$ | $I_{22}$ |
| | P3 | $I_3$ | $I_8$ | $I_{13}$ | ··· | $I_{18}$ | $I_{23}$ |
| | P4 | $I_4$ | $I_9$ | $I_{14}$ | ··· | $I_{19}$ | $I_{24}$ |
| | P5 | $I_5$ | $I_{10}$ | $I_{15}$ | ··· | $I_{20}$ | $I_{25}$ |

FIG. 21

| | | Q (L/h) | | | | | |
|---|---|---|---|---|---|---|---|
| | | 0 | Q1 | Q2 | ··· | Q3 | Q4 |
| P (kPa) | P1 | $N_1$ | $N_6$ | $N_{11}$ | | $N_{16}$ | $N_{21}$ |
| | P2 | $N_2$ | $N_7$ | $N_{12}$ | | $N_{17}$ | $N_{22}$ |
| | P3 | $N_3$ | $N_8$ | $N_{13}$ | | $N_{18}$ | $N_{23}$ |
| | P4 | $N_4$ | $N_9$ | $N_{14}$ | | $N_{19}$ | $N_{24}$ |
| | P5 | $N_5$ | $N_{10}$ | $N_{15}$ | | $N_{20}$ | $N_{25}$ |

FUEL SUPPLY DEVICE

This application is the U.S. national phase of International Application No. PCT/JP2013/006004, filed 9 Oct. 2013, which designated the U.S. and claims priority to Japanese Patent Applications No. 2012-228150 filed on Oct. 15, 2012, and No. 2013-165090 filed Aug. 8, 2013, the entire contents of each of which are hereby incorporated herein by reference.

CROSS REFERENCE TO RELATED APPLICATION

This application is based on Japanese Patent Applications No. 2012-228150 filed on Oct. 15, 2012, and No. 2013-165090 filed on Aug. 8, 2013, the disclosures of which are incorporated herein by reference.

TECHNICAL FIELD

The present disclosure relates to a fuel supply device for supplying an engine with fuel in a fuel tank.

BACKGROUND ART

There has been known a fuel supply device for supplying an engine with fuel, which is sucked by a fuel pump from a fuel tank, through a fuel passage. The fuel supply device finds voltage according to a fuel pressure, which is required by the engine, on the basis of information stored in an electronic control unit (ECU) and supplies the voltage to a motor for driving the fuel pump.

A fuel supply device described in a patent document 1 is provided with a fuel pressure sensor for sensing the pressure of fuel accumulated in a fuel rail. An ECU performs a feedback control of voltage supplied to a motor of a fuel pump in such a way that the pressure of the fuel sensed by the fuel pressure sensor is made equal to the pressure of the fuel required by the engine.

PRIOR ART LITERATURES

Patent Literature

[Patent Literature 1] U.S. Pat. No. 5,411,002

However, the fuel supply device described in the patent literature 1 is provided with the fuel pressure sensor and hence is increased in the number of the parts, so the manufacturing cost of the fuel supply device is increased. However, if the fuel pressure sensor is eliminated from the fuel supply device described in the patent literature 1, the feedback control of the voltage supplied to the motor of the fuel pump cannot be performed. For this reason, in a case where a relationship between the pressure of the fuel required by the engine and the voltage supplied to the motor is changed due to an aging change, there is a possibility that the pressure of the fuel accumulated in the fuel rail will be different from the pressure of the fuel required by the engine.

SUMMARY OF INVENTION

An objective of the present disclosure is to provide a fuel supply device that can perform a flow rate control of a fuel pump according to an aging change without a fuel pressure sensor.

In the present disclosure, in the fuel supply device having a valve in a fuel passage, on the basis of a change point at which a characteristic of voltage, current, or the number of revolutions of the motor, which is supplied to a motor of a fuel pump, is changed, the voltage, the current, or the number of revolutions of the motor, which is stored in a storage portion, is corrected.

In the fuel supply device, when the valve provided in fuel passage is opened, the load of the motor of the fuel pump is changed, so a change point is developed at which a relationship between two of the voltage, the current, and the number of revolutions of the motor, which are supplied to the motor of the fuel pump, is changed.

A calculation portion calculates a difference between the voltage, the current, or the number of revolutions of the motor, which is stored in a storage portion when the engine requires a fuel pressure (valve opening pressure), and the voltage, the current, or the number of revolutions of the motor, which is sensed by a sensing portion when the valve is opened. Then, a correction portion corrects the voltage, the current, or the number of revolutions of the motor, which is stored in the storage portion, on the basis of the difference calculated by the calculation portion.

In this way, a relationship between the fuel pressure and the fuel flow rate, which are required by the engine and are stored in the storage portion, and the voltage, the current, or the number of revolutions of the motor, which is supplied to the motor, is updated to a relationship appropriate for a real fuel supply device. For this reason, the fuel supply device can perform a correct motor control corresponding to the fuel pressure and the fuel flow rate, which are required by the engine, in correspondence to an aging change without a fuel pressure sensor. Hence, it is possible to reduce a manufacturing cost by eliminating the fuel pressure sensor and to perform a flow rate control of the fuel pump in correspondence to the aging change.

In this regard, there is not a limitation to the number of the valves but the fuel control device may be provided with one valve or a plurality of valves.

BRIEF DESCRIPTION OF THE DRAWINGS

The objective described above, the other objectives, features, and advantages of the present disclosure will be made clearer by the following detailed description with reference to the accompanying drawings.

FIG. 5 is a map to show a relationship among a fuel pressure P, a fuel flow rate Q, and voltage V after correction.

FIG. 21 is a map to show a relationship among a fuel pressure P, a fuel flow rate Q, and the number of revolutions N of a motor, which are stored in an ECU, in a fuel supply device according to a fourth embodiment of the present invention.

EMBODIMENTS FOR CARRYING OUT INVENTION

Figure 1:
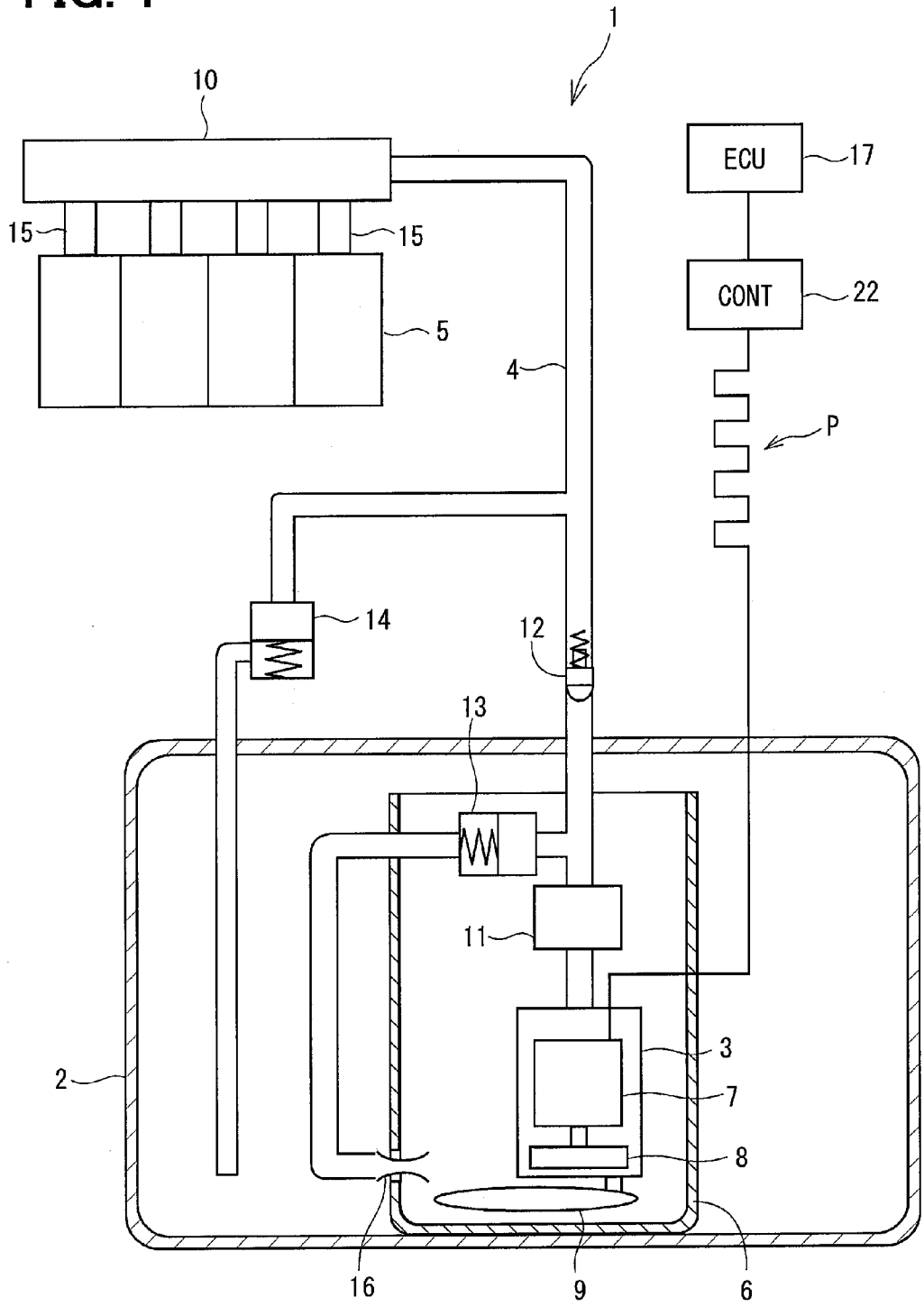
FIG. 1 is a configuration diagram of a fuel supply device according to a first embodiment of the present invention.

Hereinafter, embodiments of the present disclosure will be described on the basis of the drawings.

First Embodiment

A first embodiment of the present disclosure will be shown in FIG. 1 to FIG. 10. A fuel supply device 1 according to the present embodiment is a device for sucking up fuel in a fuel tank 2 by a fuel pump 3 and for supplying the fuel to an engine 5 through a fuel passage 4.

As shown in FIG. 1, the fuel pump 3 is provided inside a sub-tank 6 provided inside the fuel tank 2 and formed in the shape of a cylinder having a closed end. The fuel pump 3 sucks up the fuel in the sub-tank 6 through a suction filter 9 by an impeller 8 rotated along with a motor 7.

The fuel discharged from the fuel pump 3 is accumulated in a fuel rail 10 of the engine 5 through the fuel passage 4. In the fuel passage 4 are provided a high pressure filter 11, a check valve 12, a regulator valve 13 as a first valve, and a relief valve 14 as a second valve.

The high pressure filter 11 collects fine foreign particles contained in the fuel discharged from the fuel pump 3.

The check valve 12 prevents the fuel in the fuel passage 4 from reversely flowing from a fuel rail side to a fuel pump side. The fuel stored in the fuel rail 10 is injected and supplied to a cylinder of the engine 5 from an injector 15.

The regulator valve 13 is interposed between the high pressure filter 11 and the check valve 12. When the pressure of the fuel flowing in the fuel passage 4 is increased to a valve opening pressure of, for example, P1 (kPa), which is set to the regulator valve 13, the regulator valve 13 is opened to thereby return the fuel in the fuel passage 4 from a jet pump 16 to the sub-tank 6.

The jet pump 16 is provided in an opening of the sub-tank 6 and injects and supplies the fuel discharged from the regulator valve 13 into the sub-tank 6. The jet pump 16 corresponds to "an orifice". The fuel in the fuel tank 2 is made to flow into the sub-tank 6 by a negative pressure of the fuel injected from the jet pump 16. When a flow rate of the fuel discharged from the regulator valve 13 is more than a specified amount, the jet pump 16 starts to regulate a flow rate of the injected fuel. A fuel pressure at that time is, for example, P2 (kPa).

In this regard, in a case where the fuel tank 2 is partitioned into two fuel chambers, the jet pump 16 may be used for transporting the fuel from one fuel chamber to the other fuel chamber.

The relief valve 14 is interposed between the check valve 12 and the fuel rail 10. When the pressure of the fuel flowing in the fuel passage 4 is increased to a valve opening pressure, for example, P5 (kPa), which is set to the relief valve 14, the relief valve 14 is opened to thereby return the fuel in the fuel passage 4 to the fuel tank 2. That is, a valve opening pressure of the relief valve 14 is set higher than the valve opening pressure of the check valve 12.

Figure 2:
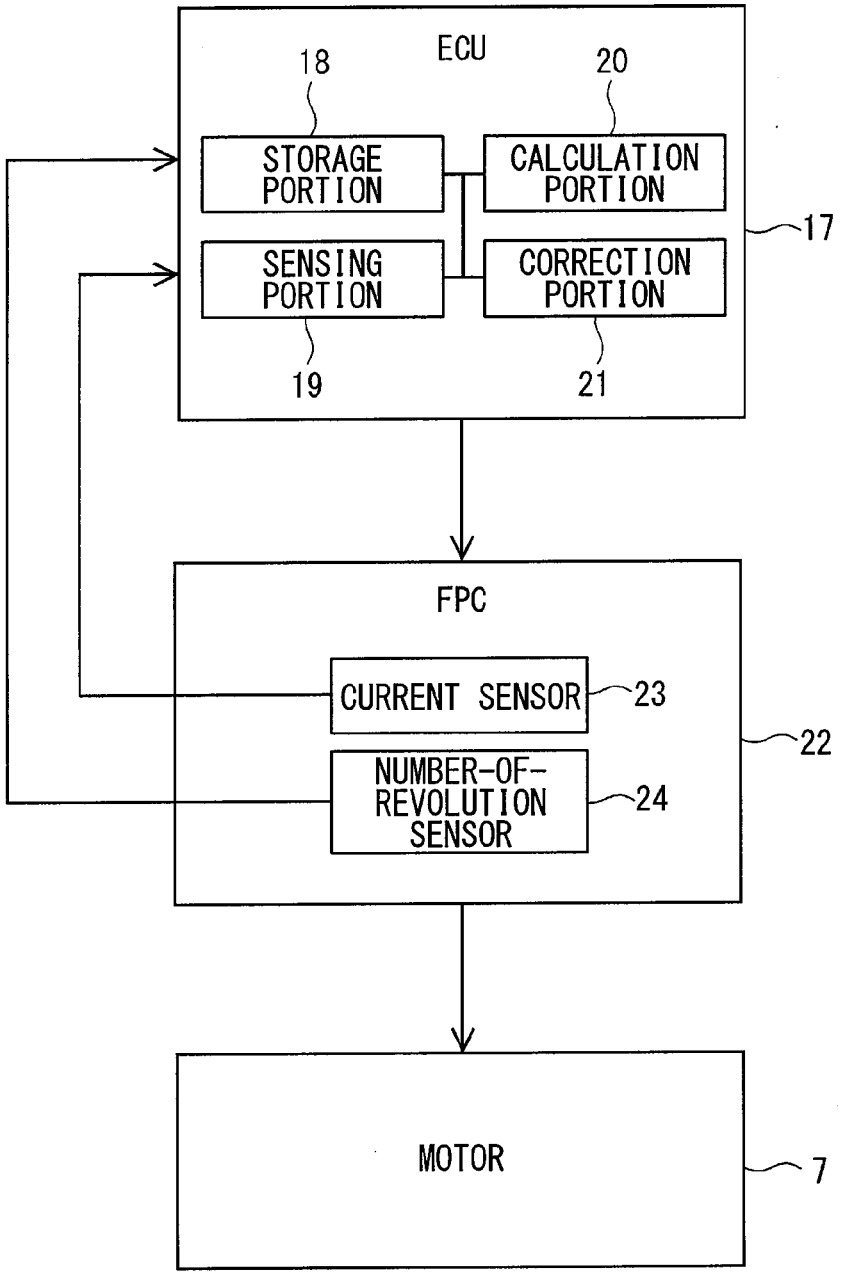
FIG. 2 is a partial configuration diagram of the fuel supply device according to the first embodiment of the present invention.

An electronic control unit (ECU) 17 has a computer constructed of a CPU, a RAM, a ROM, and the like. In FIG. 2, an internal construction of the ECU 17 is shown schematically as a storage portion 18, a sensing portion 19, a calculation portion 20, and a correction portion 21.

Figures 3, 4:
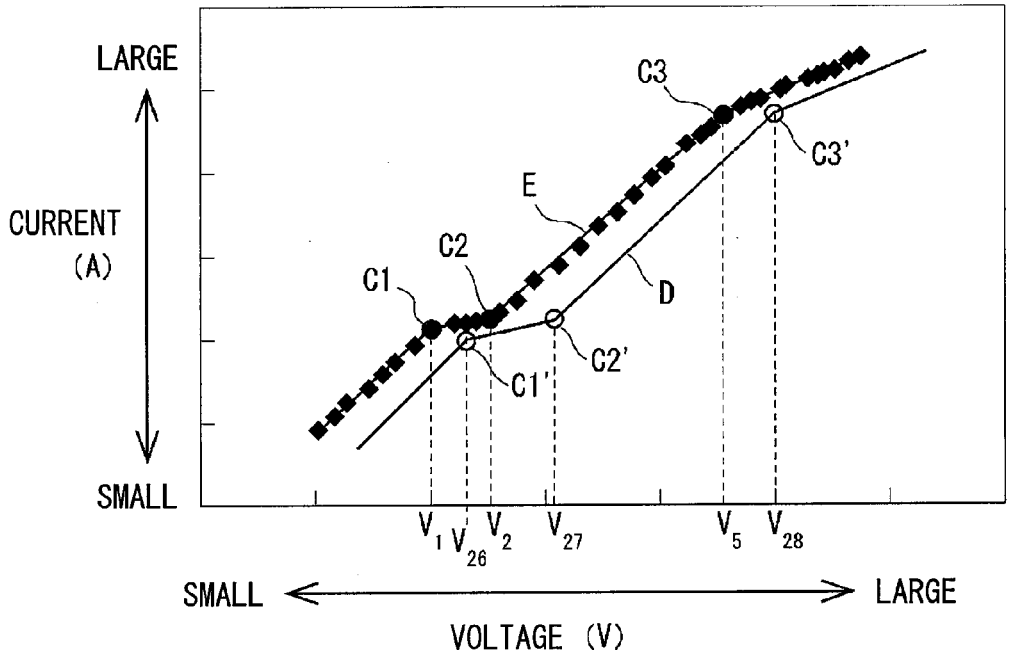
FIG. 3 is a map to show a relationship among a fuel pressure P, a fuel flow rate Q, and voltage V which are stored in an ECU.
FIG. 4 is a graph to show a characteristic between voltage V and current I which are supplied to a motor of a fuel pump.

As shown in FIG. 3, the storage portion 18 of the ECU 17 stores a relationship among a fuel flow rate Q (L/h) and a fuel pressure P (kPa), which are required by the engine 5, and a voltage V, which is supplied to the motor 7, as a map.

As shown in FIG. 2, a controller 22 supplies the voltage V corresponding to the fuel flow rate Q and the fuel pressure P, which are required by the engine 5, to the motor 7 on the basis of the map stored in the storage portion 18. A current I corresponding to the voltage V is uniquely determined. In FIG. 1, a pulse current and voltage supplied to the motor 7 from the controller 22 is shown schematically by a reference character P.

As shown in FIG. 2, a current sensor 23 senses current supplied to the motor 7 from the controller 22. A number-of-revolutions sensor 24 senses the number of revolutions of the motor 7. A current value sensed by the current sensor 23 and the number of revolutions sensed by the number-of-revolutions sensor 24 are transmitted to the ECU 17.

When the fuel flow rate Q required by the engine 5 is constant (for example, Q=0 L/h), a relationship between voltage V (V) and current I (A) applied to the motor 7 is shown by square dots and a solid line E connecting the square dots in FIG. 4.

When the voltage V applied to the motor 7 is gradually increased, a characteristic between the voltage V and the current I is changed at specified voltages V1, V2, and V5.

That is, when the regulator valve 13 is opened, when the jet pump 16 starts to regulate a flow rate of the jet pump 16, and when the relief valve 14 is opened, the fluid resistance of the fuel passage 4 is changed and hence the load of the motor 7 is changed. For this reason, a change is developed in the characteristic between the voltage V and the current I.

In the first embodiment, a point at which the characteristic between the voltage V and the current I is changed at the time when the regulator valve 13 is opened is referred to as a first change point C1. A point at which the characteristic between the voltage V and the current I is changed at the time when the jet pump 16 starts to regulate a flow rate is referred to as a second change point C2. A point at which the characteristic between the voltage V and the current I is changed at the time when the relief valve 14 is opened is referred to as a third change point C3.

Here, when the fuel supply device 1 is continuously used as shown by a solid line D of FIG. 4, the fuel discharged by the fuel pump 3 can be decreased for the voltage applied to the motor 7 in some cases due to an aging change. Even in this case, when the regulator valve 13 is opened, when the jet pump 16 starts to regulate the flow rate, and when the relief valve 14 is opened, the load of the motor 7 is changed. For this reason, a first change point C1', a second change point C2', and a third change point C3', at which the characteristic between the voltage V and the current I is changed, are developed at specified voltages V26, V27, and V28 which are different from the voltages before the aging change being caused.

The fuel supply device 1 of the first embodiment is a device for controlling a flow rate of the fuel pump 3 corresponding to an aging change by the use of the change points at which the characteristic between the voltage V and the current I is changed.

Figure 7:
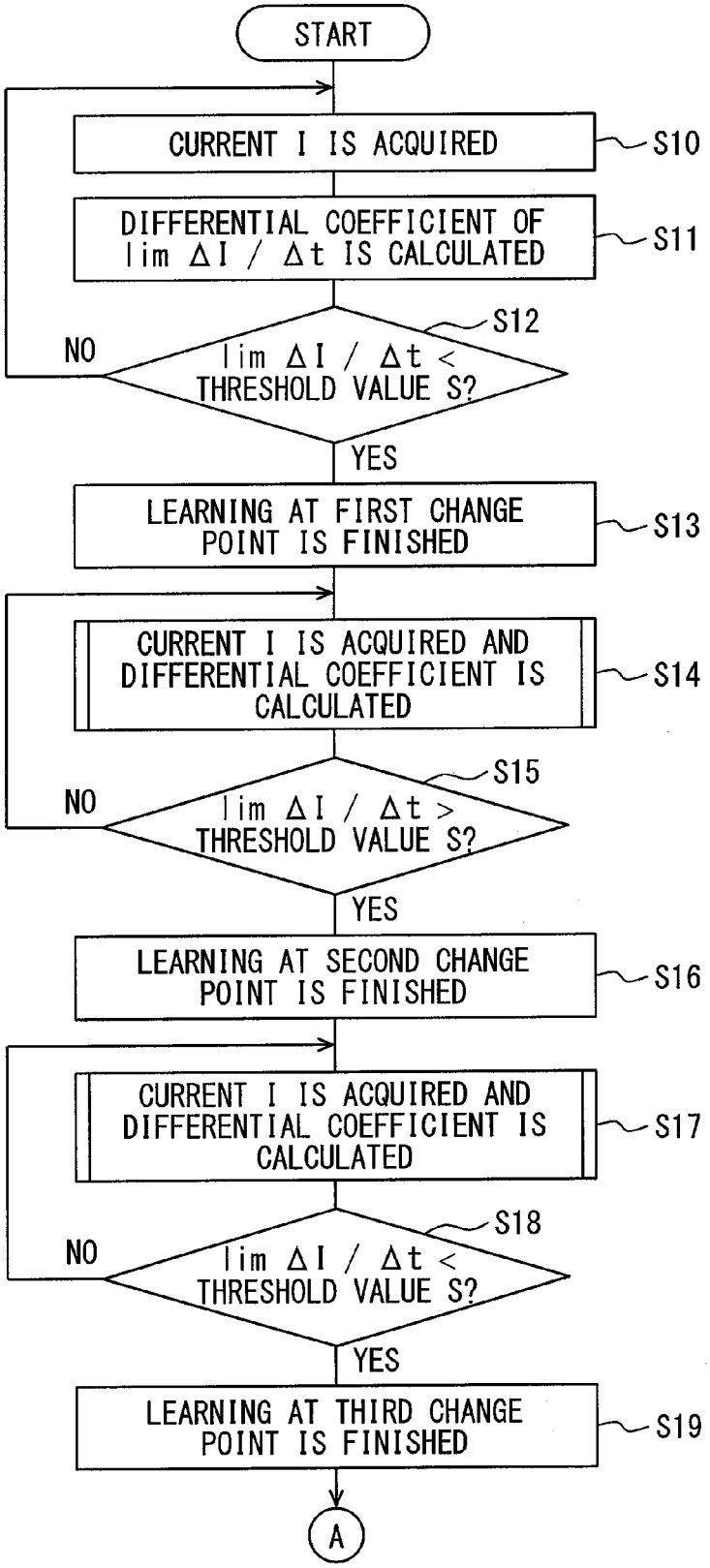
FIG. 7 is a flow chart of the current value learning or the number-of-revolutions learning.
Figure 8:
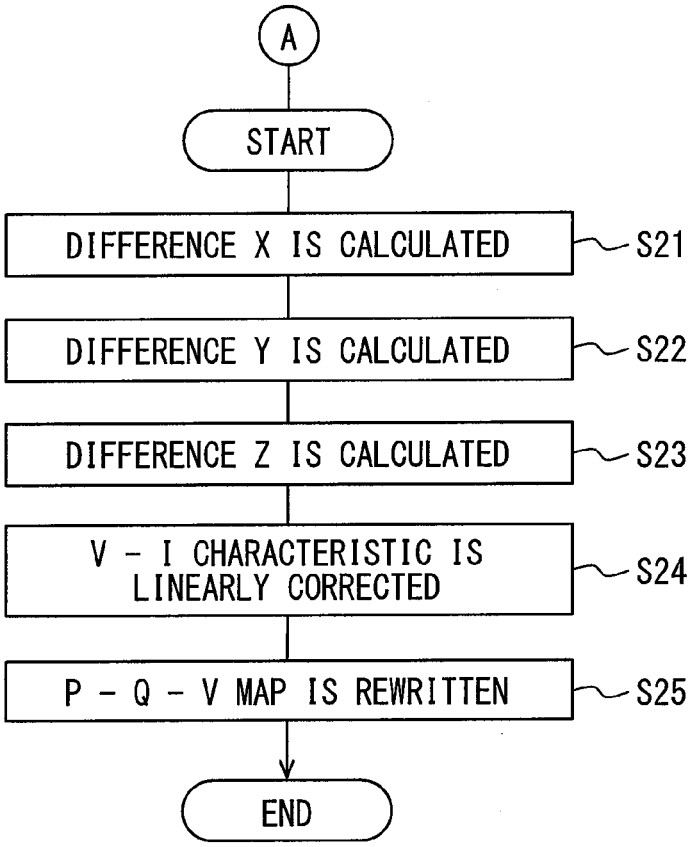
FIG. 8 is a flow chart of the map correction processing.
Figure 9:
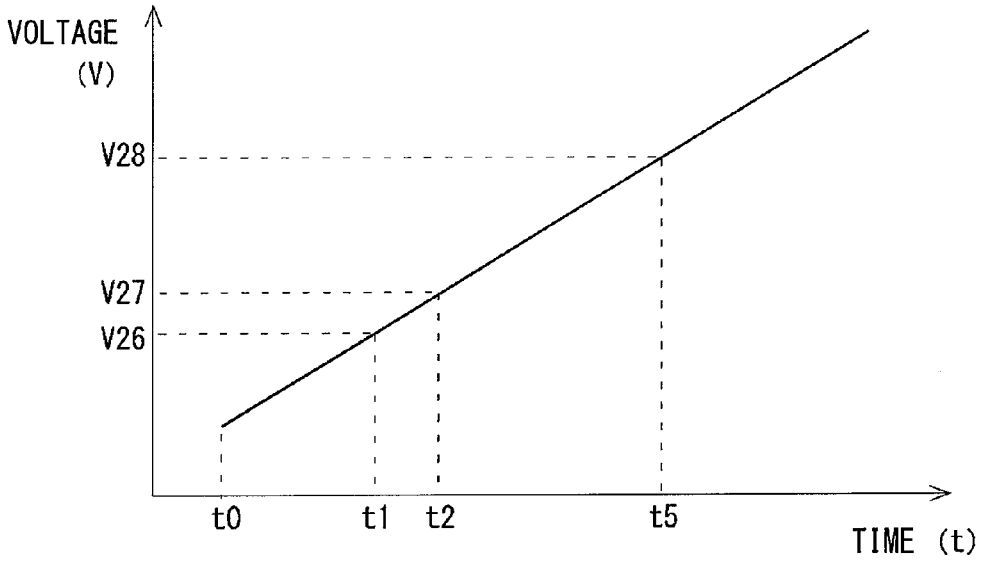
FIG. 9 is a graph to show a relationship between time and voltage when the pump is continuously driven.
Figure 10:
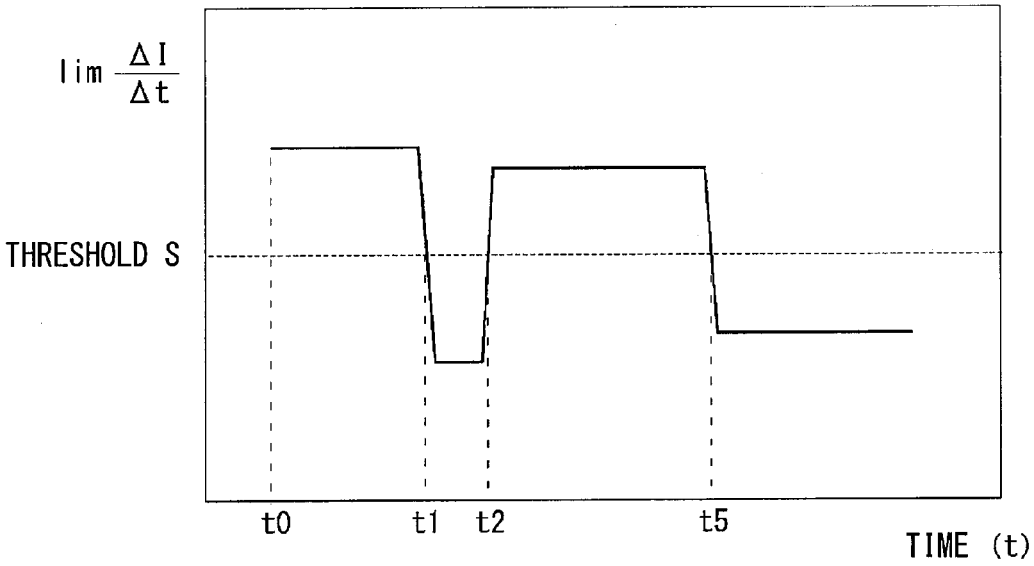
FIG. 10 is a graph to show a differential coefficient of current with respect to time when the pump is continuously driven.

"A current value learning or a number-of-revolutions learning" and "a map correction processing" in the fuel supply device 1 of the first embodiment will be described with reference to flow charts shown in FIG. 6 to FIG. 8 and graphs shown in FIG. 9 and FIG. 10.

Figure 6:
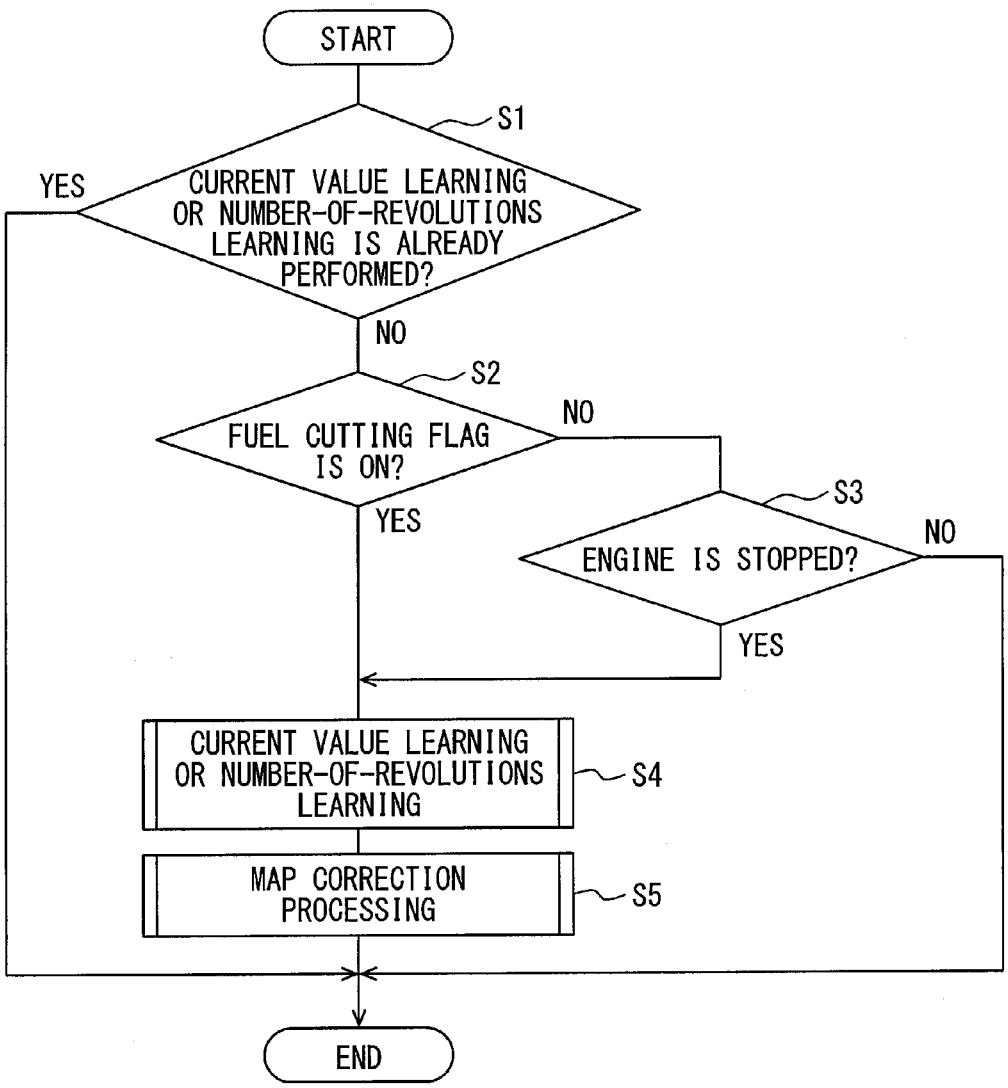
FIG. 6 is a flow chart of a current value learning or a number-of-revolutions learning and a map correction processing.

As shown in FIG. 6, when a fuel flow rate Q required by the engine 5 is constant at a value of, for example, 0, the fuel supply device 1 performs "the current value learning or the number-of-revolutions learning" and "the map correction processing". This routine of processing is performed, for example, when a vehicle is tripped once.

In step S1, the ECU 17 determines whether or not "the current value learning or the number-of-revolutions learning" is already performed. When "the current value learning or the number-of-revolutions learning" is already performed, the routine is finished. When "the current value learning or the number-of-revolution learning" is not performed, the routine proceeds to step 2.

In step 2, it is determined whether or not a fuel cutting, that is, a fuel supply to the engine 5 is interrupted. If the fuel cutting is performed, because the fuel flow rate Q required by the engine 5 is 0, "the current value learning or the number-of-revolutions learning" in step 4 and "the map correction processing" in step 5 are performed. If the fuel cutting is not performed, the routine proceeds to step 3.

In step 3, it is determined whether or not the driving of the engine 5 is stopped. If the engine 5 is stopped, because the fuel flow rate Q required by the engine 5 is 0, the processing in step 4 and the processing in step 5 are performed. If the engine 5 is not stopped, the routine is finished.

"The current value learning or the number-of-revolutions learning" performed by the fuel supply device 1 will be described with reference to FIG. 7.

In "the current value learning or the number-of-revolutions learning", the ECU 17 "continuously drives" the fuel pump 3. The "continuously drives" means that, as shown in FIG. 9, the voltage supplied to the motor 7 is increased at a specified rate continuously for a specified time to thereby drive the fuel pump 3.

In step 10, the sensing portion 19 acquires a current I when the fuel pump 3 is "continuously driven" by the output of the current sensor 23.

Next, in step 11, the sensing portion 19 calculates a temporal change speed of the current I, that is, a differential coefficient of the current I with respect to time t. A differential coefficient at this time will be shown in FIG. 10. The differential coefficient is larger than a threshold value S during a period from time t0 to time t1, and the differential coefficient is smaller than the threshold value S during a period from the time t1 to time t2.

In step 12, it is determined whether or not the differential coefficient is smaller than the threshold value S. The time t1 when the differential coefficient becomes smaller than the threshold value S first after "the fuel pump 3 starts to be continuously driven" means the time when the first change point C1' caused by the regulator valve 13 being opened is developed.

If it is determined in step 12 that the differential coefficient is smaller than the threshold value S, the routine proceeds to step 13.

In step 13, the voltage V26 applied to the motor 7 at the time t1 and the current I by the output of the current sensor 23 at that time are learned. The voltage V26 and the current I are those supplied to the motor 7 by the controller 22 when the regulator valve 13 is opened.

In step 14, the sensing portion 19 performs the same processings as in the steps 10, 11.

In step 15, it is determined whether or not the differential coefficient is larger than the threshold value S. The time t2 when the differential coefficient becomes larger than the threshold value S after the time t1 means the time when the second change point C2' caused by the jet pump 16 starting to regulate a flow rate is developed.

If it is determined in step 15 that the differential coefficient is larger than the threshold value S, the routine proceeds to step 16.

In step 16, the voltage V27 applied to the motor 7 at the time t2 and the current I by the output of the current sensor 23 at that time are learned. The voltage V27 and the current I are those supplied to the motor 7 by the controller 22 when the jet pump 16 starts to regulate a flow rate.

In step 17, the sensing portion 19 performs the same processings as in the steps 10, 11.

In step 18, it is determined whether or not the differential coefficient is smaller than the threshold value S. The time t5 when the differential coefficient becomes smaller than the threshold value S after the time t2 means the time when the third change point C3 caused by the relief valve 14 being opened is developed.

If it is determined in step 18 that the differential coefficient is smaller than the threshold value S, the routine proceeds to step 19.

In step 19, the voltage V28 applied to the motor 7 at the time t5 and the current I by the output of the current sensor 23 at that time are learned. The voltage V28 and the current I are those supplied to the motor 7 by the controller 22 when the relief valve 14 is opened.

Next, "the map correction processing" performed by the fuel supply device 1 will be described with reference to FIG. 8.

In step 21, the calculation portion 20 calculates a difference between the voltage V1 and the current I at the first change point C1, which are stored in the map of the storage portion 18 before starting "the current value learning or the number-of-revolutions learning", and the voltage V26 and the current I at the first change point C1', which are learned in step 13. This difference will be referred to as a difference X.

In step 22, the calculation portion 20 calculates a difference between the voltage V2 and the current I at the second change point C2, which are stored in the map of the storage portion 18 before starting "the current value learning or the number-of-revolutions learning", and the voltage V27 and the current I at the second change point C2', which are learned in step 16. This difference will be referred to as a difference Y.

In step 23, the calculation portion 20 calculates a difference between the voltage V5 and the current I at the third change point C3, which are stored in the map of the storage portion 18 before starting "the current value learning or the number-of-revolutions learning", and the voltage V28 and the current I at the third change point C3', which are learned in step 19. This difference will be referred to as a difference Z.

In the next step 24, the correction portion 21 linearly corrects the characteristic between the voltage V and the current I as shown by the solid line D of FIG. 4 on the basis of the differences X, Y, Z. That is, the solid line D is a line connecting the first change point C1', the second change point C2', and the third change point C3' by straight lines. Here, as to a voltage lower than the first change point C1', the difference X is added to the voltage stored in the map. As to a voltage higher than the third change point C3', the difference Z is added to the voltage stored in the map.

In step 25, as shown in FIG. 5, the voltage V supplied to the motor 7 is rewritten in the map stored in the storage portion 18 on the basis of the linear correction of step 24. The voltage V and the current I between the first change point C1' and the second change point C2' are thought to be in a proportional relationship, and the voltage V and the current I between the second change point C2' and the third change point C3' are thought to be in another proportional relationship, so that, for example, voltages V corresponding to P3 (kPa) and P4 (kPa) can be rewritten on the basis of the proportional coefficients of their relationships.

Further, each voltage V corresponding to each fuel flow rate Q other than 0 (L/h) can be corrected by adding each difference, which is added to each voltage V corresponding to each fuel pressure P of the fuel flow rate Q=0, to each voltage V corresponding to each fuel pressure P of each fuel flow rate other than 0 (L/h).

For example, a voltage V29 when the fuel flow rate Q is Q1 (L/h) and the fuel pressure is P1 (kPa) is acquired by adding the difference X to a voltage V6 of FIG. 3. Further, a voltage V38 when the fuel flow rate Q is Q2 (L/h) and the fuel pressure is P5 (kPa) is acquired by adding the difference Z to a voltage V15 of FIG. 3.

In this regard, the value of the voltage V corresponding to the fuel flow rate in a case where the fuel flow rate Q required by the engine 5 is other than 0 (L/h) can be corrected also by the following method.

For example, when a vehicle is subjected to a cruise control, the fuel flow rate Q required by the engine 5 is set at a constant value. If "the current value learning or the number-of-revolutions learning" and "the map correction processing" described above are performed at this time, the voltage V corresponding to the fuel flow rate Q required by the engine 5 can be corrected.

The fuel supply device 1 of the first embodiment produces the following operations and effects.

(1) When the fuel flow rate required by the engine 5 is constant, the fuel supply device 1 of the first embodiment corrects the map of the fuel flow rate Q, the fuel pressure P, and the voltage V supplied to the motor, which is stored in the storage portion 18, on the basis of the voltage V26, V27, and V28 sensed from the change points C1', C2', and C3' of the relationship between the voltage V and the current I supplied to the motor 7 of the fuel pump 3.

In this way, even if the fuel supply device 1 is not provided with the fuel pressure sensor, the fuel supply device 1 can perform a correct motor control corresponding to the fuel pressure P and the fuel flow rate Q required by the engine 5 in correspondence to an aging change. Hence, it is possible to reduce a manufacturing cost by eliminating the fuel pressure sensor and to perform a flow rate control of the fuel pump 3 in correspondence to the aging change.

(2) The fuel supply device 1 of the first embodiment is provided with the regulator valve 13, the jet pump 16, and the relief valve 14. In this way, the fuel supply device 1 can linearly correct the map stored in the storage portion 18 on the basis of three change points C1', C2', and C3'. Hence, the fuel supply device 1 can correctly control the flow rate of the fuel pump 3 in correspondence to the aging change.

(3) The fuel supply device 1 of the first embodiment performs "the continuous driving of the fuel pump 3" of continuously increasing the voltage V to be supplied to the motor 7 of the fuel pump 3 at the specified rate for the specified time and calculates the differential coefficient of the current I to be supplied to the motor 7 at that time with respect to the time t. Then, when the differential coefficient is more than the specified threshold value S, the fuel supply device 1 senses the change points C1', C2', and C3' at which the characteristic between the voltage V and the current I, which are to be supplied to the motor 7, is changed. In this way, the fuel supply device 1 can detect the voltage V26 at the time t1 when the regulator valve 13 is opened, the voltage V27 at the time t2 when the jet pump 16 starts to regulate a fuel flow rate, and the voltage V28 at the time t5 when the relief valve 14 is opened.

Second Embodiment

A fuel supply device according to a second embodiment of the present invention will be described on the basis of FIG. 11 to FIG. 14. Hereinafter, in a plurality of embodiments, the same constructions as in the first embodiment described above will be denoted by the same reference characters and their descriptions will be omitted.

In the second embodiment, a flow rate control of the fuel pump 3 corresponding to an aging change is performed on the basis of change points at which a characteristic between the voltage V applied to the motor 7 and the number of revolutions N of the motor sensed by the number-of-revolutions sensor 24.

Figure 11:
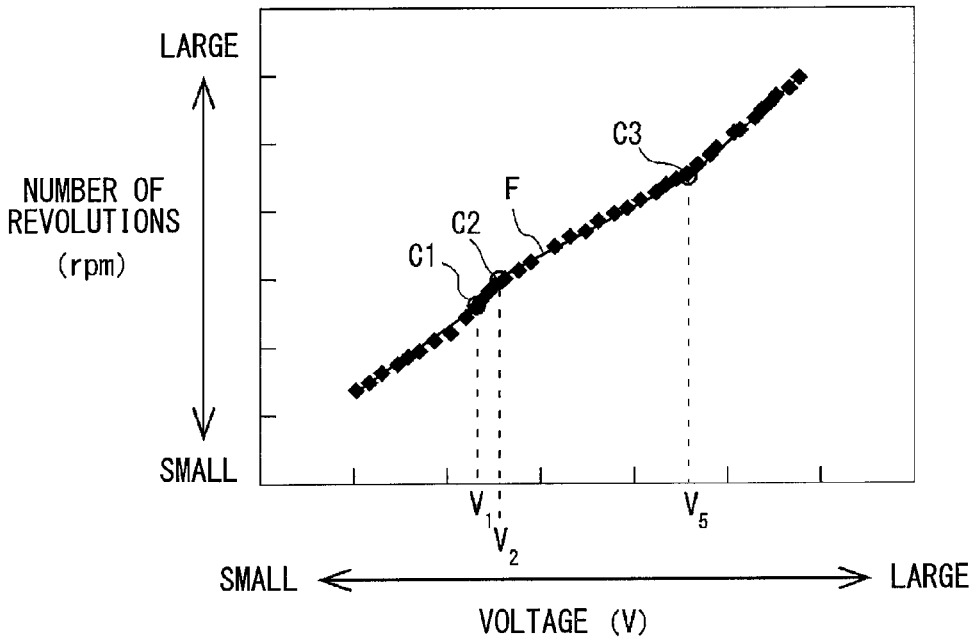
FIG. 11 is a graph to show a characteristic between voltage V and the number of revolutions N of the motor, which are supplied to a motor of a fuel pump, in a fuel supply device according to a second embodiment of the present invention.

When the fuel flow rate Q required by the engine 5 is 0, a relationship between the voltage V (V) applied to the motor 7 and the number of revolutions N (rpm) of the motor 7 is shown in FIG. 11 by square dots and solid lines F connecting the square dots.

When the voltage V applied to the motor 7 is gradually increased, change points at which the characteristic between the voltage V and the number of revolutions N of the motor is changed is developed at specified voltages V1, V2, and V5. Also in the second embodiment, a point at which the characteristic between the voltage V and the number of revolutions N of the motor is changed at the time when the regulator valve 13 is opened is referred to as the first change point C1. A point at which the characteristic between the voltage V and the number of revolutions N of the motor is changed at the time when the jet pump 16 starts to regulate a flow rate is referred to as the second change point C2. A point at which the characteristic between the voltage V and the number of revolutions N of the motor is changed at the time when the relief valve 14 is opened is referred to as the third change point C3.

Also in the second embodiment, although not shown in the drawing, when the fuel supply device is continuously used, the first change point C1', the second change point C2', and the third change point C3' at which the characteristic between the voltage V and the number of revolutions N of the motor is changed due to the aging change are developed at specified voltages different from those before the aging change being caused.

"A current value learning or a number-of-revolutions learning" and "a map correction processing" in the fuel supply device of the second embodiment will be described with reference to flow charts shown in FIG. 12 and FIG. 13 and a graph shown in FIG. 14.

When the fuel flow rate Q required by the engine 5 is constant at a value of 0, the fuel supply device performs "the current value learning or the number-of-revolutions learning" and "the map correction processing". A routine of starting to perform "the current value learning or the number-of-revolutions learning" and "the map correction processing" is the same as the routine shown in FIG. 6 of the first embodiment, so its description will be omitted.

In this regard, when the fuel flow rate Q required by the engine 5 is constant at a value other than 0, the fuel supply device also can perform "the current value learning or the number-of-revolutions learning" and "the map correction processing".

Figure 12:
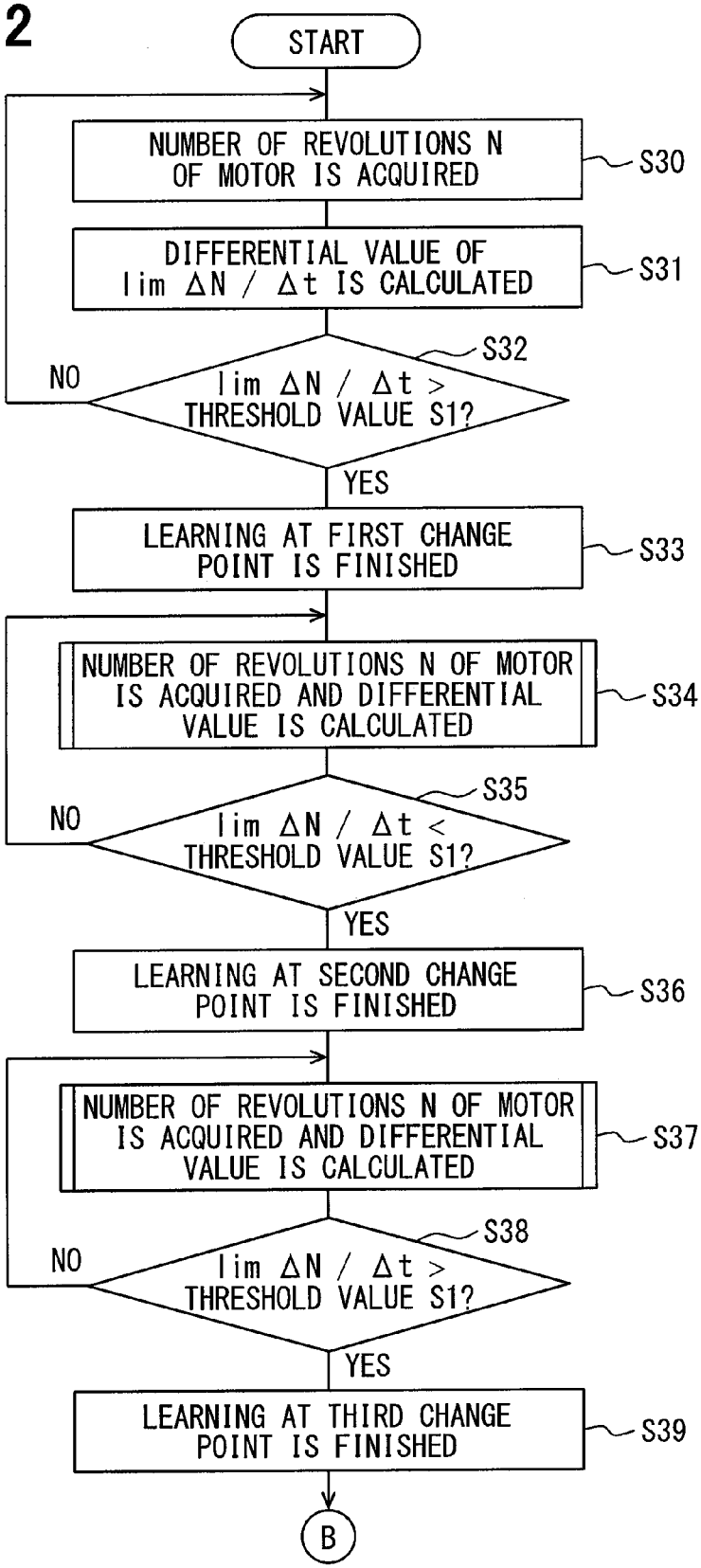
FIG. 12 is a flow chart of a current value learning or a number-of-revolutions learning.
Figure 13:
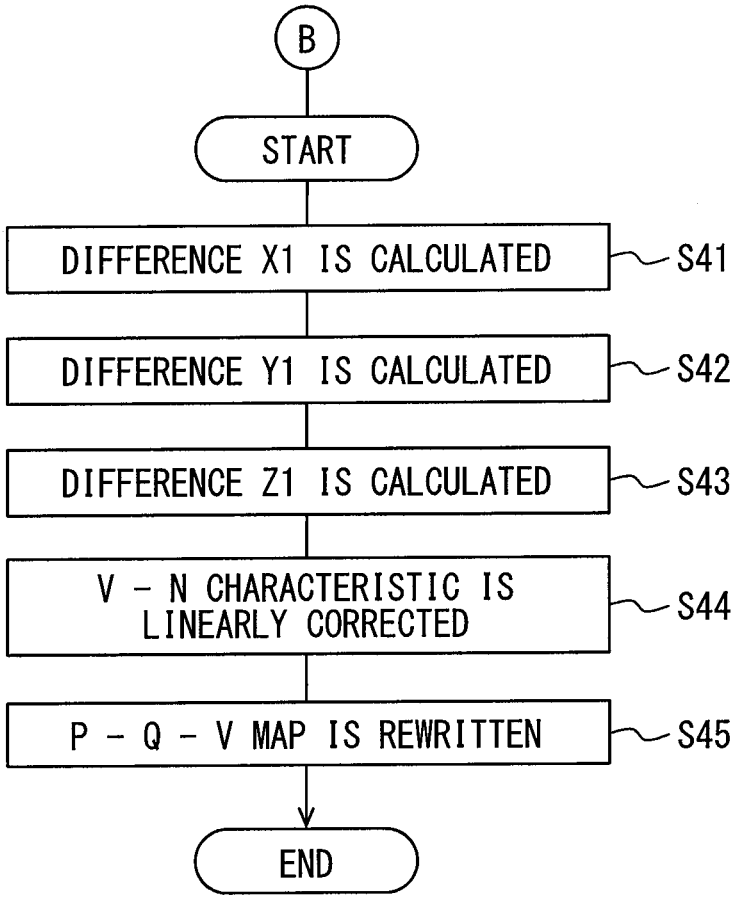
FIG. 13 is a flow chart of a map correction processing.

As shown in FIG. 12, in "the current value learning or the number-of-revolutions learning", the ECU 17 "continuously drives" the fuel pump 3. In step 30, the sensing portion 19 acquires the number of revolutions N of the motor at that time from the output of the number-of-revolutions sensor 24.

Next, in step 31, the sensing portion 19 calculates a temporal change speed of the number of revolutions N of the motor, that is, a differential coefficient of the number of revolutions N of the motor with respect to time t. The differential coefficient at this time will be shown in FIG. 14. The differential coefficient is smaller than a threshold value S1 during a period from time t0 to time t1 and the differential coefficient is larger than the threshold value S1 during a period from the time t1 to time t2.

In step 32, it is determined whether or not the differential coefficient is larger than the threshold value S1. The time t1 when the differential coefficient becomes larger than the threshold value S1 first after "the fuel pump 3 starts to be continuously driven" means the time when the first change point C1' caused by the regulator valve 13 being opened is developed.

In step 33, the voltage V applied to the motor 7 at the time t1 and the number of revolutions N of the motor at that time are learned.

In step 34, the sensing portion 19 performs the same processings as in the steps 30, 31.

In step 35, it is determined whether or not the differential coefficient is smaller than the threshold value S1. The time t2 when the differential coefficient becomes smaller than the threshold value S1 after the time t1 means the time when the second change point C2' caused by the jet pump 16 starting to regulate a flow rate is developed.

In step 36, the voltage V applied to the motor 7 at the time t2 and the number of revolutions N of the motor at that time are learned.

In step 37, the sensing portion 19 performs the same processings as in the steps 30, 31.

In step 38, it is determined whether or not the differential coefficient is larger than the threshold value S1. The time t5 when the differential coefficient becomes larger than the threshold value S1 after the time t2 means the time when the third change point C3' caused by the relief valve 14 being opened is developed.

In step 39, the voltage V applied to the motor 7 at the time t5 and the number of revolutions N of the motor at that time are learned.

Subsequently, "the map correction processing" performed by the fuel supply device will be described with reference to FIG. 13.

In step 41, the calculation portion 20 calculates a difference between the voltage V1 and the number of revolutions N of the motor at the first change point C1, which are stored in the map of the storage portion 18 before starting "the current value learning or the number-of-revolutions learning", and the voltage V and the number of revolutions N of the motor at the first change point C1', which are learned in step 33. This difference will be referred to as a difference X1.

In step 22, the calculation portion 20 calculates a difference between the voltage V2 and the number of revolutions N of the motor at the second change point C2, which are stored in the map of the storage portion 18 before starting "the current value learning or the number-of-revolutions learning", and the voltage V and the number of revolutions N of the motor at the second change point C2', which are learned in step 36. This difference will be referred to as a difference Y1.

In step 43, the calculation portion 20 calculates a difference between the voltage V1 and the number of revolutions N of the motor at the third change point C3, which are stored in the map of the storage portion 18 before starting "the current value learning or the number-of-revolutions learning", and the voltage V and the number of revolutions N of the motor at the third change point C3', which are learned in step 39. This difference will be referred to as a difference Z1.

In the next step 44, the correction portion 21 linearly corrects the characteristic between the voltage V and the number of revolutions N of the motor on the basis of the differences X1, Y1, Z1.

In step 45, the voltage V supplied to the motor 7 is rewritten in the map stored in the storage portion 18 on the basis of the linear correction of step 44.

When the fuel flow rate required by the engine 5 is constant, the fuel supply device of the second embodiment corrects the map of the fuel flow rate Q, the fuel pressure P, and the voltage V supplied to the motor, which is stored in the storage portion 18, on the basis of the voltage V sensed at the change points C1', C2', and C3' of the relationship between the voltage V supplied to the motor 7 of the fuel pump 3 and the number of revolutions N of the motor. In this way, the fuel supply device can eliminate the fuel pressure sensor and can perform a flow rate control of the fuel pump 3 in correspondence to the aging change.

Third Embodiment

A fuel supply device according to a third embodiment of the present invention will be described on the basis of FIG. 15 to FIG. 20.

Figures 14, 15:
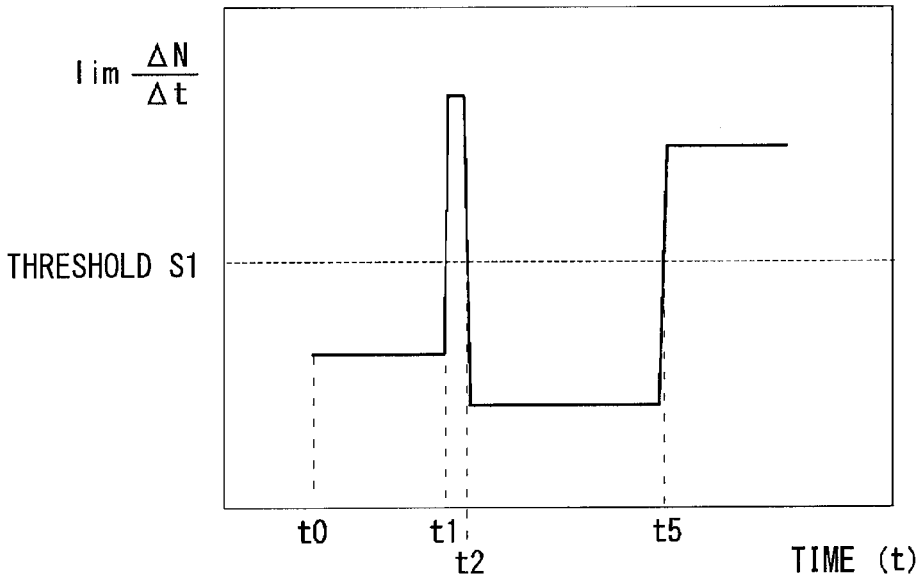
FIG. 14 is a graph to show a differential coefficient of the number of revolutions of a motor with respect to time when the pump is continuously driven.
FIG. 15 is a map to show a relationship among a fuel pressure P, a fuel flow rate Q, and current I, which are stored in an ECU, in a fuel supply device according to a third embodiment of the present invention.

In the third embodiment, as shown in FIG. 15, the storage portion 18 of the ECU 17 stores a relationship among a fuel flow rate Q (L/h) and a fuel pressure P (kPa), which are required by the engine 5, and a current I, which is supplied to the motor 7, as a map. The controller 22 supplies the current I corresponding to the fuel flow rate Q and the fuel pressure P, which are required by the engine 5, to the motor 7 on the basis of the map stored in the storage portion 18.

The fuel supply device controls a flow rate of the fuel pump 3 in correspondence to an aging change on the basis of the current I supplied to the motor 7 and the number of revolutions N of the motor, which is sensed by the number-of-revolutions sensor 24.

Figure 16:
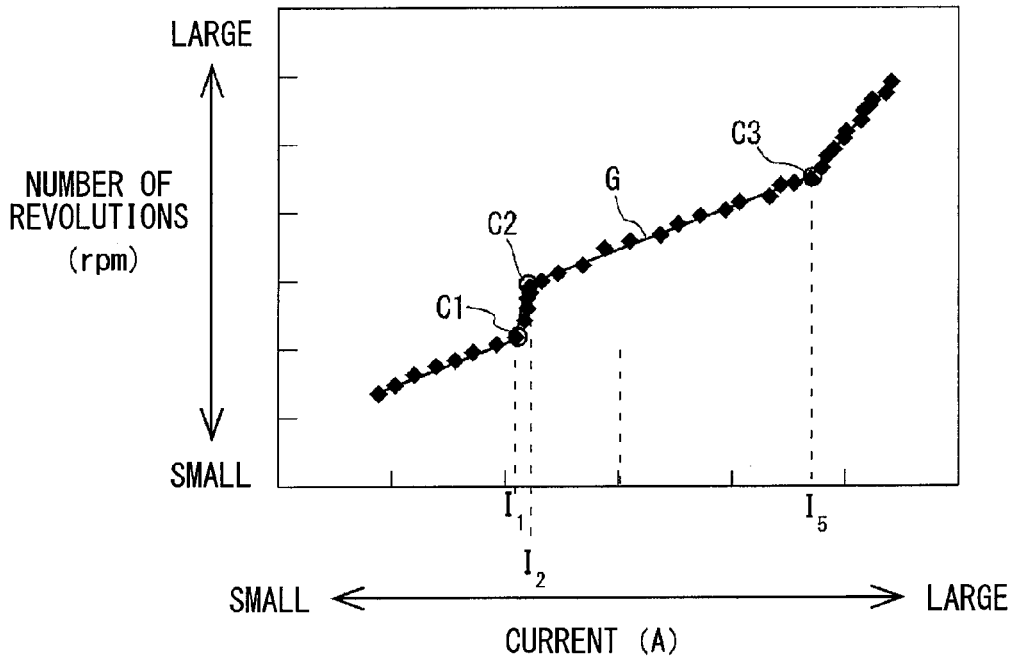
FIG. 16 is a graph to show a characteristic between current I, which is supplied to a motor of a fuel pump, and the number of revolutions of the motor.

When the fuel flow rate Q required by the engine 5 is 0, the relationship between the current I (A) supplied to the motor 7 and the number of revolutions N (rpm) of the motor 7 is shown by square dots and solid lines G connecting the square dots in FIG. 16.

When the current I supplied to the motor 7 is gradually increased, change points at which the characteristic between the current I and the number of revolutions N of the motor is changed is developed at specified currents I1, I2, and I5. Also in the third embodiment, a point at which the characteristic between the current I and the number of revolutions N of the motor is changed at the time when the regulator valve 13 is opened is referred to as a first change point C1. A point at which the characteristic between the current I and the number of revolutions N of the motor is changed at the time when the jet pump 16 starts to regulate a flow rate is referred to as a second change point C2. A point at which the characteristic between the current I and the number of revolutions N of the motor is changed at the time when the relief valve 14 is opened is referred to as a third change point C3.

Also in the third embodiment, although not shown in the drawing, when the fuel supply device is continuously used, a first change point C1', a second change point C2', and a third change point C3' at which the characteristic between the current I and the number of revolutions N of the motor is changed due to the aging change are developed at specified voltages different from those before the aging change being caused.

Figure 18:
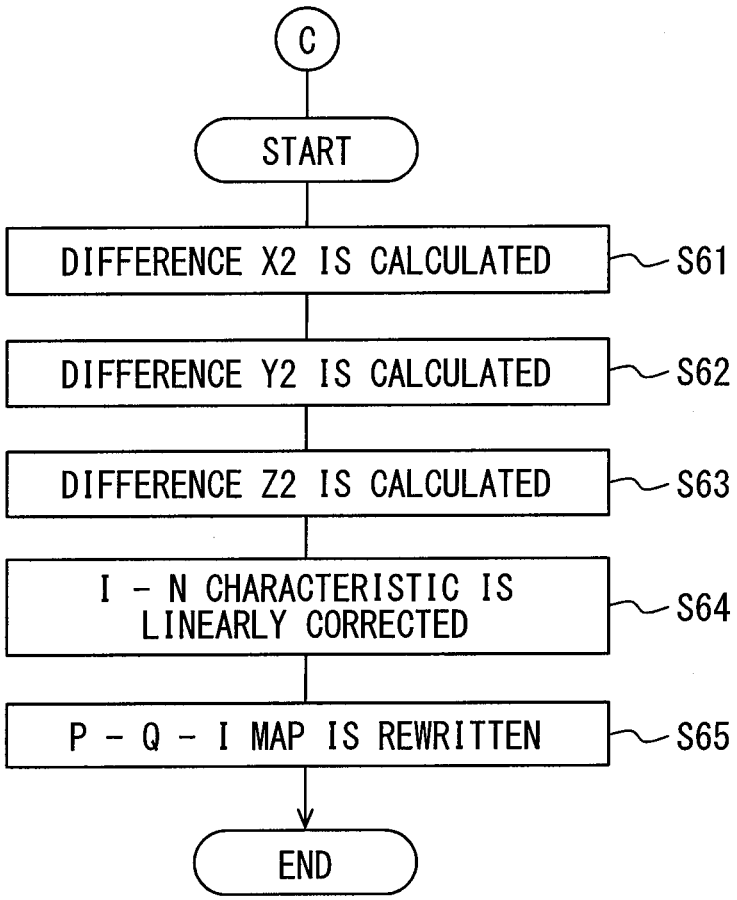
FIG. 18 is a flow chart of a map correction processing.
Figure 19:
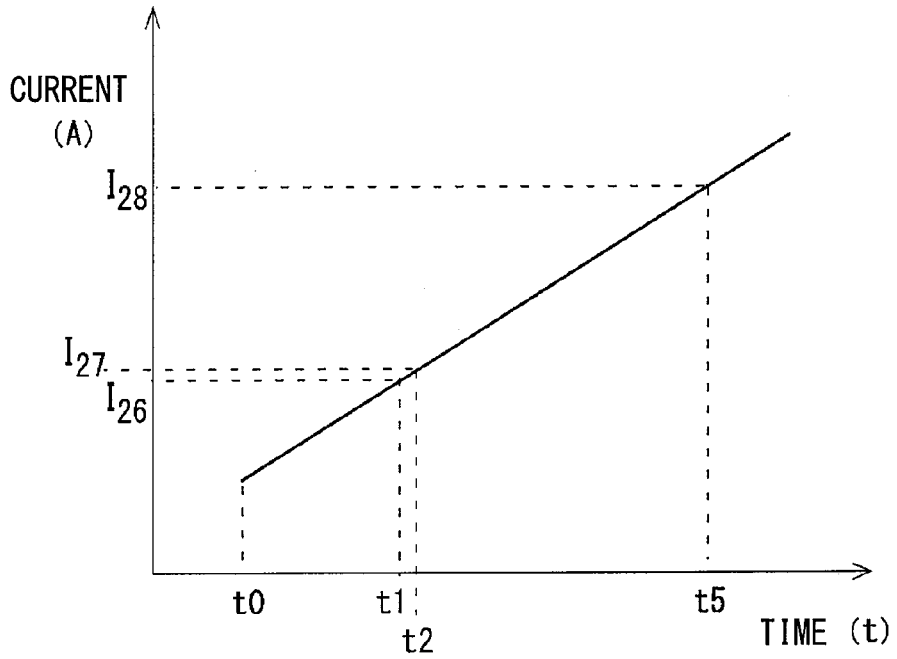
FIG. 19 is a graph to show a relationship between time and current when the pump is continuously driven.
Figure 20:
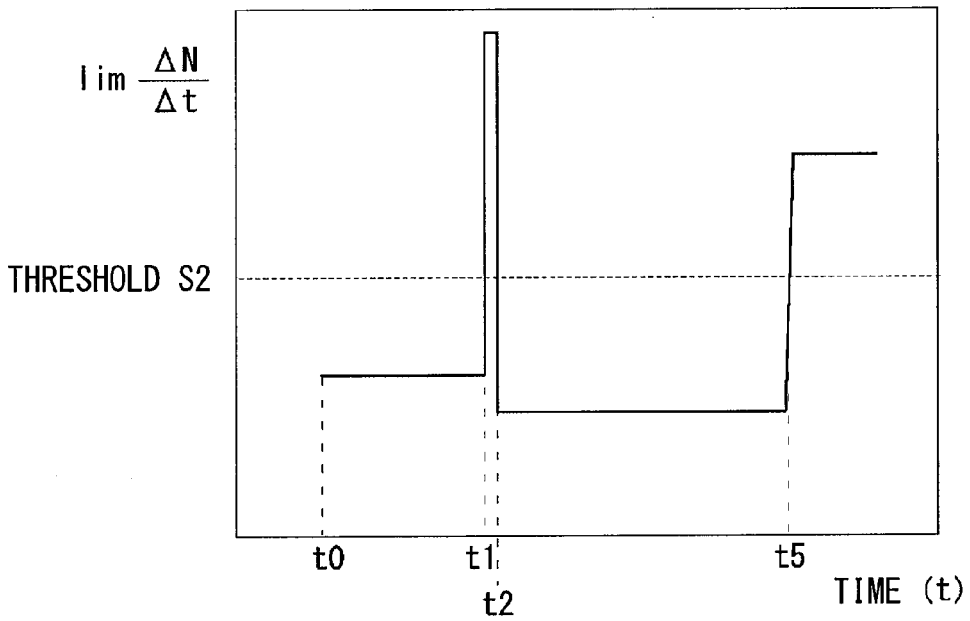
FIG. 20 is a graph to show a differential coefficient of the number of revolutions of a motor with respect to time when the pump is continuously driven.

"A current value learning or a number-of-revolutions learning" and "a map correction processing" in the fuel supply device of the third embodiment will be described with reference to flow charts shown in FIG. 17 and FIG. 18 and graphs shown in FIG. 19 and FIG. 20.

A routine of starting to perform "the current value learning or the number-of-revolutions learning" and "the map correction processing" are the same as the routine shown in FIG. 6 of the first embodiment, so its description will be omitted.

Figure 17:
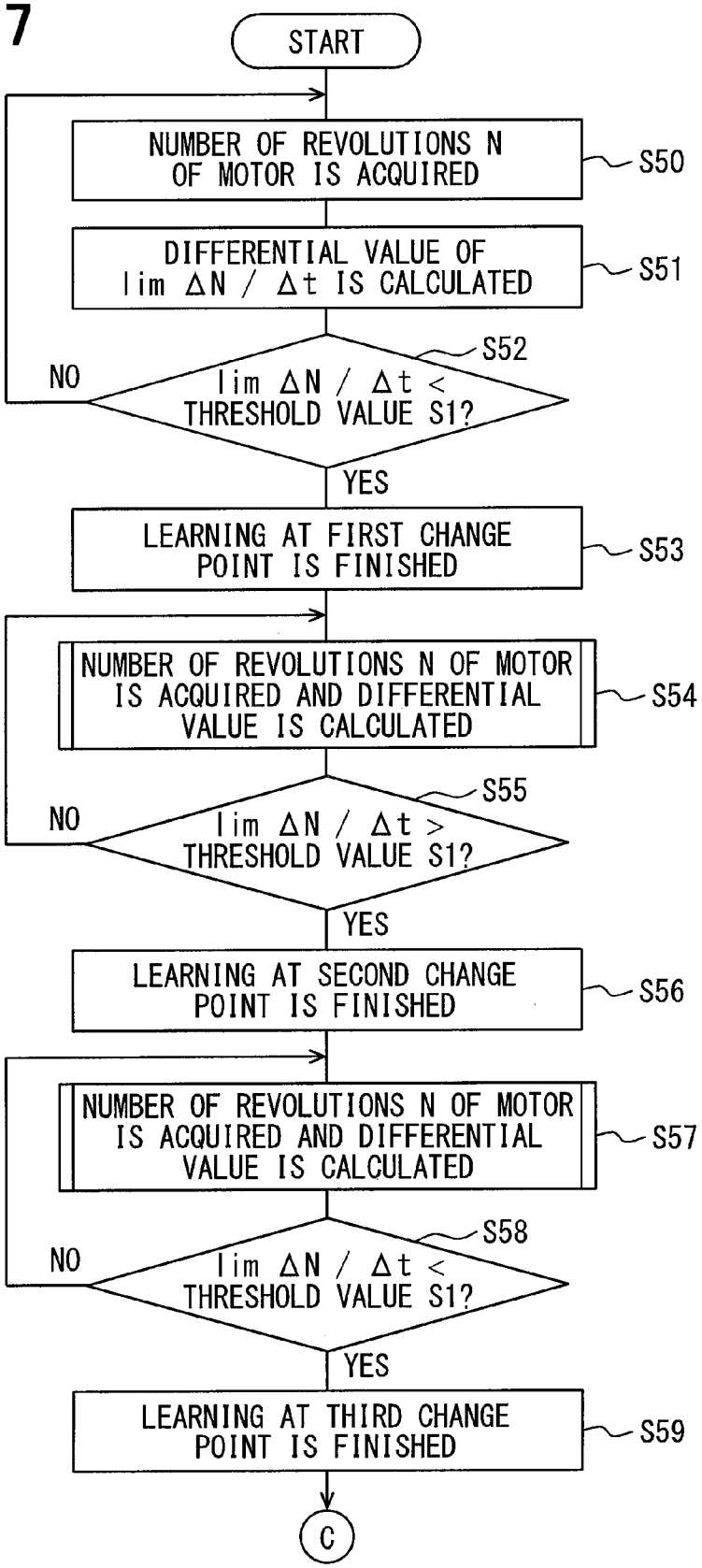
FIG. 17 is a flow chart of a current value learning or a number-of-revolutions learning.

As shown in FIG. 17, in "the current value learning or the number-of-revolutions learning", the ECU 17 "continuously drives" the fuel pump 3. The "continuously drives" in the third embodiment means that, as shown in FIG. 19, the current supplied to the motor 7 is increased at a specified rate continuously for a specified time to thereby drive the fuel pump 3.

In step 50, the sensing portion 19 acquires the number of revolutions N of the motor at the time when the fuel pump 3 "is continuously driven" from the output of the number-of-revolutions sensor 24.

Next, in step 51, the sensing portion 19 calculates a temporal change speed of the number of revolutions N of the motor, that is, a differential coefficient of the number of revolutions N of the motor with respect to time t. A differential coefficient at this time will be shown in FIG. 20.

In step 52, it is determined whether or not the differential coefficient is larger than a threshold value S2. The time t1 when the differential coefficient becomes larger than the threshold value S2 first after the fuel pump 3 starts to "be continuously driven" means the time when the first change point C1' caused by the regulator valve 13 being opened is developed.

In step 53, the current I supplied to the motor 7 at the time t1 and the number of revolutions N of the motor at that time are learned.

In step 54, the sensing portion 19 performs the same processings as in the steps 50, 51.

In step 55, it is determined whether or not the differential coefficient is smaller than the threshold value S2. The time t2 when the differential coefficient becomes smaller than the threshold value S2 after the time t1 means the time when the second change point C2' caused by the jet pump 16 starting to regulate a flow rate is developed.

In step 56, the current I supplied to the motor 7 at the time t2 and the number of revolutions N of the motor at that time are learned.

In step 57, the sensing portion 19 performs the same processings as in the steps 50, 51.

In step 58, it is determined whether or not the differential coefficient is larger than the threshold value S2. The time t5 when the differential coefficient becomes larger than the threshold value S2 after the time t2 means the time when the third change point C3' caused by the relief valve 14 being opened is developed.

In step 59, the current I supplied to the motor 7 at the time t5 and the number of revolutions N of the motor at that time are learned.

Subsequently, "the map correction processing" performed by the fuel supply device will be described with reference to FIG. 18.

In step 61, the calculation portion 20 calculates a difference between the current I and the number of revolutions N of the motor at the first change point C1, which are stored in the map of the storage portion 18 before starting "the current value learning or the number-of-revolutions learning", and the current I and the number of revolutions N of the motor at the first change point C1', which are learned in step 53. This difference will be referred to as a difference X2.

In step 62, the calculation portion 20 calculates a difference between the current I and the number of revolutions N of the motor at the second change point C2, which are stored in the map of the storage portion 18 before starting "the current value learning or the number-of-revolutions learning", and the current I and the number of revolutions N of the motor at the second change point C2', which are learned in step 56. This difference will be referred to as a difference Y2.

In step 63, the calculation portion 20 calculates a difference between the current I and the number of revolutions N of the motor at the third change point C3, which are stored in the map of the storage portion 18 before starting "the current value learning or the number-of-revolutions learning", and the current I and the number of revolutions N of the motor at the third change point C3', which are learned in step 59. This difference will be referred to as a difference Z2.

In the next step 64, the correction portion 21 linearly corrects the characteristic between the current I and the number of revolutions N of the motor on the basis of the differences X2, Y2, Z2.

In step 65, the current I supplied to the motor 7 is rewritten in the map stored in the storage portion 18 on the basis of the linear correction of step 64.

When the fuel flow rate required by the engine 5 is constant, the fuel supply device of the third embodiment corrects the map of the fuel flow rate Q, the fuel pressure P, and the current I supplied to the motor, which is stored in the storage portion 18, on the basis of the current I sensed from the change points C1', C2', and C3' of the relationship between the current I supplied to the motor 7 of the fuel pump 3 and the number of revolutions N of the motor. In this way, the fuel supply device can eliminate the fuel pressure sensor and can perform a flow rate control of the fuel pump 3 in correspondence to the aging change.

Fourth Embodiment

A fuel supply device according to a fourth embodiment of the present invention will be described on the basis of FIG. 21.

In the fourth embodiment, as shown in FIG. 21, the storage portion 18 of the ECU 17 stores a relationship among a fuel flow rate Q (L/h) and a fuel pressure P (kPa), which are required by the engine 5, and the number of revolutions N of the motor as a map. The controller 22 monitors a signal outputted from the number-of-revolutions sensor 24 and performs a feedback control of electricity to be supplied to the motor 7 so as to achieve the number of revolutions N of the motor 7 corresponding to the fuel flow rate Q (L/h) and the fuel pressure P, which are required by the engine 5, on the basis of the map stored in the storage portion 18.

The fuel supply device controls the flow rate of the fuel pump 3 in correspondence to an aging change by the use of a change point at which the characteristic between the number of revolutions N of the motor 7 and the current I supplied to the motor 7 is changed.

Although not shown in the drawing, when the number of revolutions N of the motor 7 is gradually increased, a change point at which the characteristic between the number of revolutions N of the motor 7 and the current I is changed is developed at a specified number of revolutions N of the motor 7.

In the fourth embodiment, a point at which the characteristic between the number of revolutions N of the motor 7 and the current I is changed at the time when the regulator valve 13 is opened is referred to as a first change point C1. A point at which the characteristic between the number of revolutions N of the motor 7 and the current I is changed at the time when the jet pump 16 starts to regulate a flow rate is referred to as a second change point C2. A point at which the characteristic between the number of revolutions N of the motor 7 and the current I is changed at the time when the relief valve 14 is opened is referred to as a third change point C3.

When the fuel supply device is continuously used, a first change point C1', a second change point C2', and a third change point C3' at which the characteristic between the number of revolutions N of the motor 7 and the current I is changed due to the aging change are developed at a specified number of revolutions N different from that before the aging change being caused.

In "the current value learning or the number-of-revolutions learning" and "the map correction processing" in the fuel supply device of the fourth embodiment, the fuel pump 3 is controlled in such a way that the number of revolutions of the motor 7 is continuously increased at a specified rate for a specified time. At that time, change points C1', C2', C3' at which the characteristic between the number of revolutions N of the motor 7 and the current I is changed are developed at a specified number of revolutions N of the motor 7.

In "the current value learning or the number-of-revolutions learning" and "the map correction processing" in the fourth embodiment, as is the case with the first embodiment described above, a temporal change speed of the current I, that is, a differential coefficient of the current I with respect to time is calculated. Then, it is determined whether or not the differential coefficient is larger than a threshold value, and the number of revolutions N of the motor 7 and the current I at the respective change points are learned.

Then, differences between the number of revolutions N of the motor 7 and the current I at each of the change points, which are stored in the map of the storage portion 18 before starting to perform "the current value learning or the number-of-revolution learning", and the number of revolutions N of the motor 7 and the current I at each of the learned change points are calculated, respectively, and the characteristic between the number of revolutions N of the motor 7 and the current I is linearly corrected. The number of revolutions N of the motor 7 stored in the storage portion 18 is rewritten on the basis of the linear correction.

When the fuel flow rate required by the engine 5 is constant, the fuel supply device of the fourth embodiment corrects the map of the fuel flow rate Q, the fuel pressure P, and the number of revolutions N of the motor 7 stored in the storage portion 18 by the use of number of revolutions N of the motor 7 which is sensed from the change points C1', C2', C3' at which the characteristic between the current supplied to the motor 7 of the fuel pump 3 and the number of revolutions N of the motor 7 is changed. In this way, the fuel supply device can eliminate the fuel pressure sensor and can control a flow rate control of the fuel pump 3 in correspondence to the aging change.

Here, as a modified example of the fourth embodiment, although not shown in the drawing, when the number of revolutions N of the motor 7 is gradually increased, change points C1', C2', C3' at which the characteristic between the number of revolutions N of the motor 7 and "the voltage V" is changed is developed at a specified number of revolutions N of the motor 7.

For this reason, when the fuel flow rate required by the engine 5 is constant, the fuel supply device of the modified example of the fourth embodiment may correct the map of the fuel flow rate Q, the fuel pressure P, and the number of revolutions N of the motor 7, which is stored in the storage portion 18, on the basis of the number of revolutions N of the motor 7 sensed from the change points C1', C2', C3' at which the characteristic between the voltage V applied to the motor 7 of the fuel pump 3 and the number of revolutions N of the motor 7 is changed.

Fifth Embodiment

A fuel supply device according to a fifth embodiment of the present invention will be described on the basis of FIG. 22 and FIG. 23.

In the fourth embodiment, the regulator valve 13 and the relief valve 14 are provided with sensors 30, 31 each of which can electrically or magnetically sense that its valve body is opened or closed.

Figure 22:
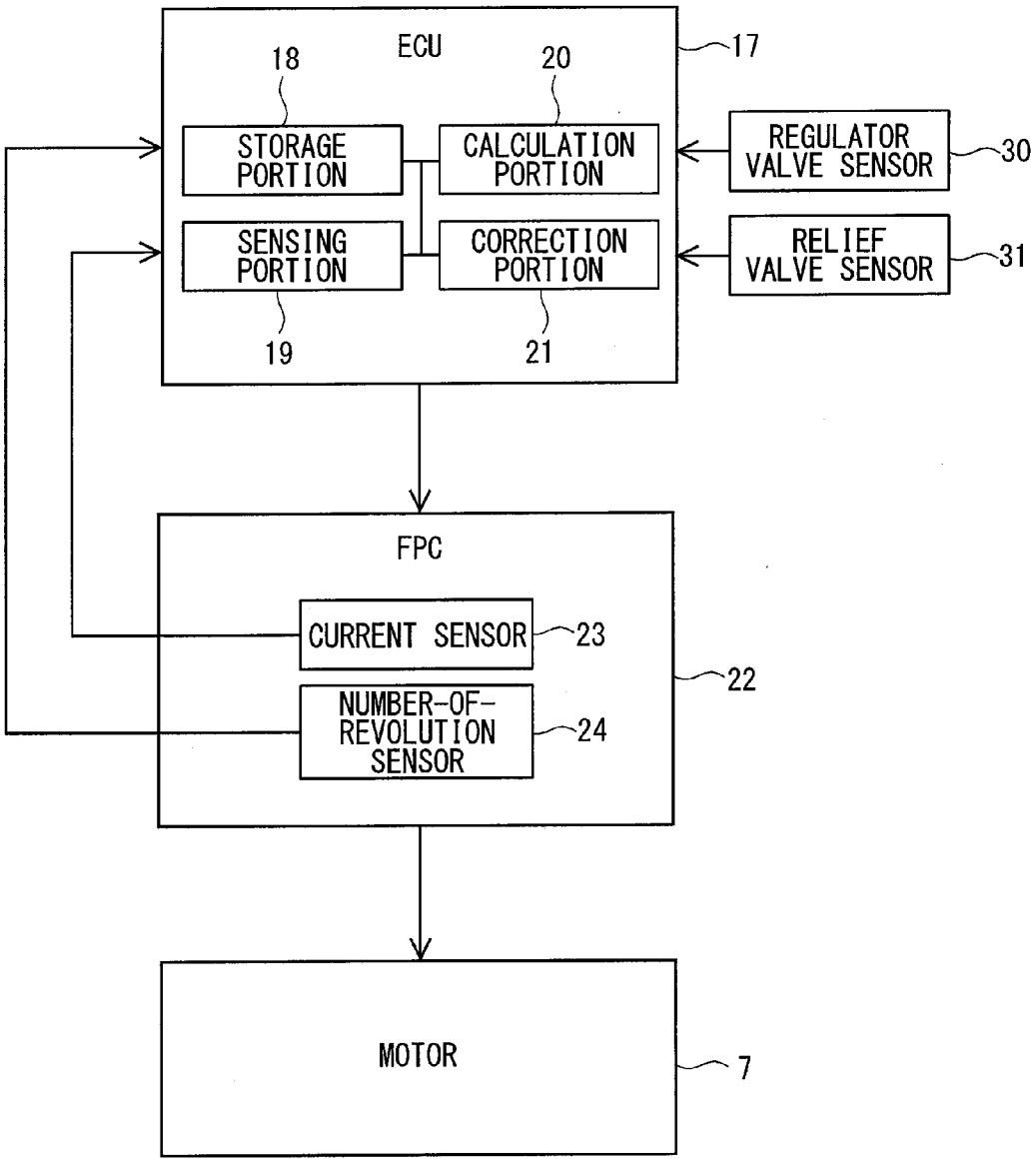
FIG. 22 is a partial configuration diagram of a fuel supply device according to a fifth embodiment of the present invention.
Figure 23:
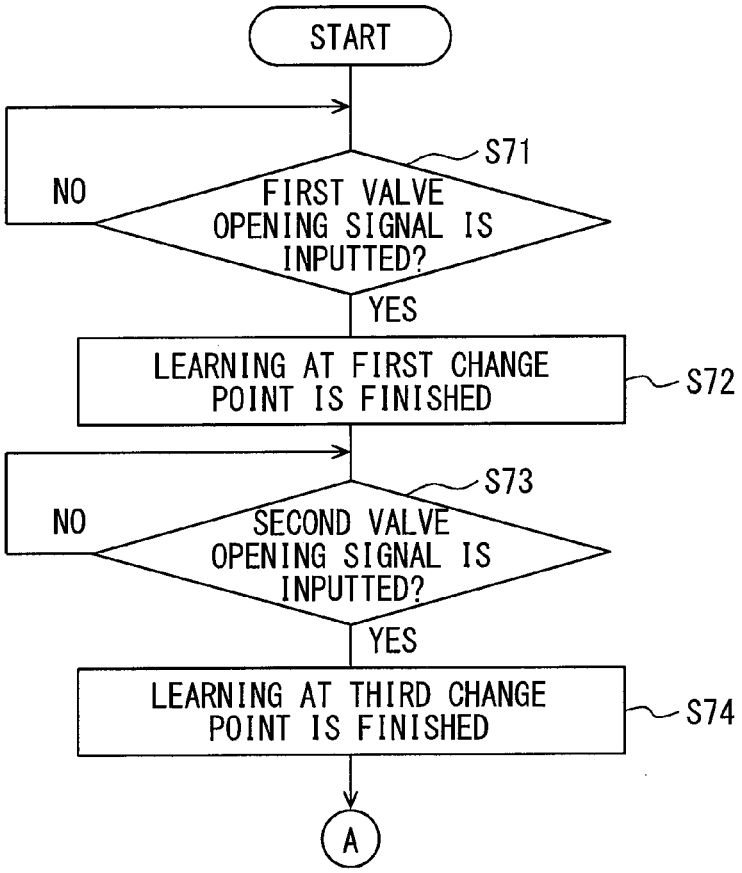
FIG. 23 is a flow chart of a current value learning or a number-of-revolutions learning.

As shown in FIG. 22, an output signal of the sensor 30 for sensing that the regulator valve 13 is opened or closed and an output signal of the sensor 31 for sensing that the relief valve 14 is opened or closed are inputted to the ECU 17.

Hereinafter, the output signal of the sensor 30 for informing that the regulator valve 13 is opened is referred to as a first valve opening signal, whereas the output signal of the sensor 31 for informing that the relief valve 14 is opened is referred to as a second valve opening signal.

The sensing portion 19 of the ECU 17 can sense any one of the following change points (a) to (e) by the first valve opening signal and the second valve opening signal: (a) a change point at which the characteristic between the voltage V applied to the motor 7 and the current I sensed by the current sensor 23 is changed; (b) a change point at which the characteristic between the voltage V applied to the motor 7 and the number of revolutions N of the motor 7 sensed by the number-of-revolutions sensor 24 is changed; (c) a change point at which the characteristic between the current I supplied to the motor 7 and the number of revolutions N of the motor 7 sensed by the number-of-revolutions sensor 24 is changed; (d) a change point at which the characteristic between the number of revolutions N of the motor 7 sensed by the number-of-revolutions sensor 24 and the current I supplied to the motor 7 is changed; and (e) a change point at which the characteristic between the number of revolutions N of the motor 7 sensed by the number-of-revolutions sensor 24 and the voltage V applied to the motor 7 is changed.

"The current value learning or the number-of-revolutions learning" and "the map correction processing" in the fuel supply device of the fifth embodiment will be described with reference to a flow chart shown in FIG. 23.

The processing is performed when the fuel flow rate Q required by the engine 5 is 0 or at a specified value.

The ECU 17 increases the voltage V applied to the motor 7 continuously for a specified time at a specified rate, thereby continuously driving the fuel pump 3.

In step 71, the sensing portion 19 senses whether or not the first valve opening signal is inputted. If the first valve opening signal is inputted, the routine proceeds to step 72.

In step 72, the voltage V applied to the motor 7 at the time t1 when the first valve opening signal is inputted and the current I by the output of the current sensor 23 at that time are learned.

In step 73, the sensing portion 19 senses whether or not the second valve opening signal is inputted. If the first valve opening signal is inputted, the routine proceeds to step 74.

In step 74, the voltage V applied to the motor 7 at the time t5 when the second valve opening signal is inputted and the current I by the output of the current sensor 23 at that time are learned.

"The map correction processing" performed subsequently by the fuel supply device is the same as the processing described in FIG. 8 of the first embodiment, so its description will be omitted.

In the fifth embodiment, there are provided the sensors for sensing that the valve bodies of the regulator valve 13 and the relief valve 14 are opened and hence the ECU 17 can omit a processing of calculating a differential coefficient and a processing of comparing the differential coefficient with a threshold value. Hence, the load of the ECU 17 can be reduced.

Sixth Embodiment

A fuel supply device according to a sixth embodiment of the present invention will be described on the basis of FIG. 24 to FIG. 27.

Figure 26:
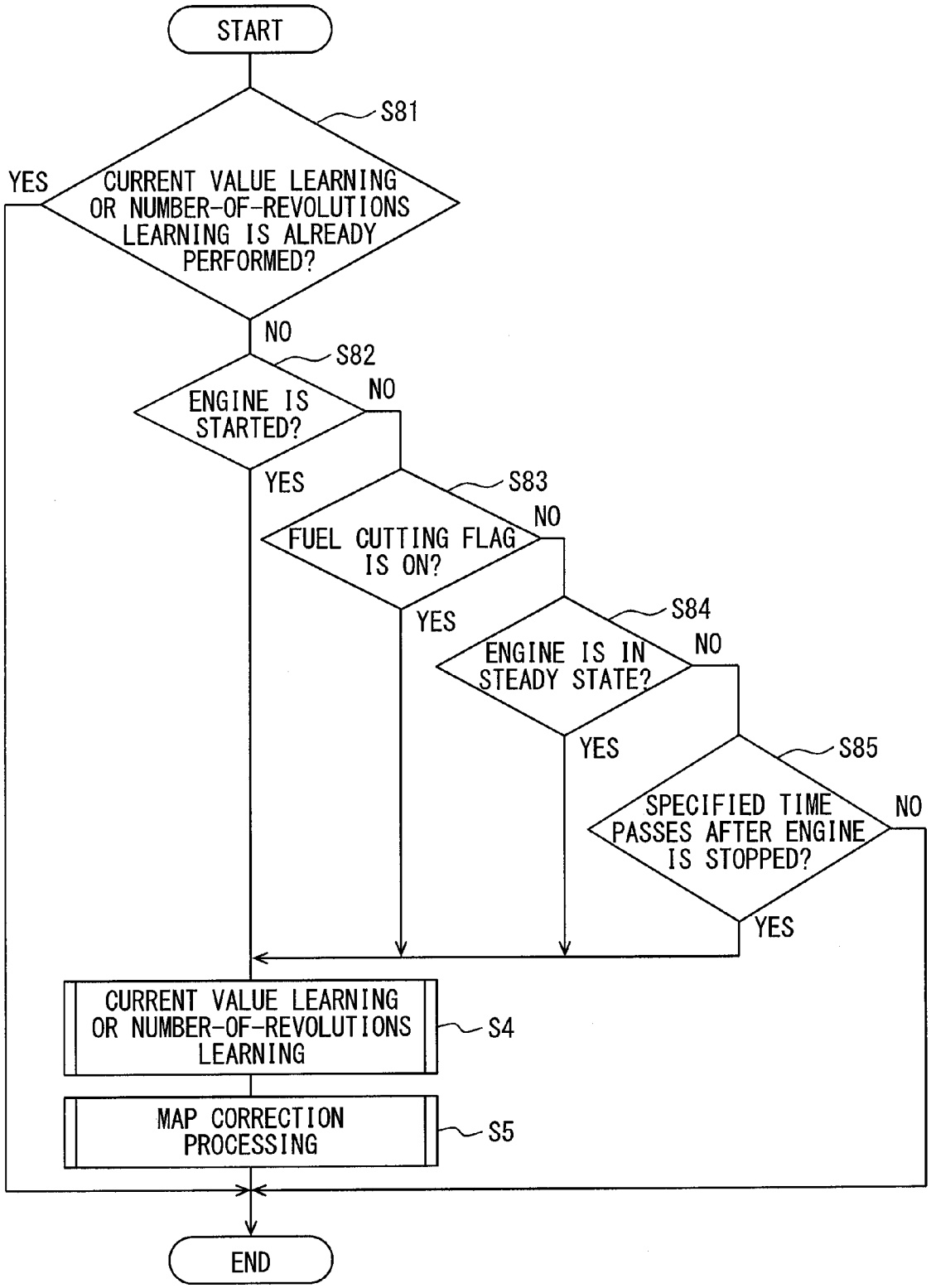
FIG. 26 is a flow chart of a current value learning or a number-of-revolutions learning and a map correction processing.

In the sixth embodiment, as shown by a flow chart of FIG. 26, when the engine 5 is started, when the flow rate of the fuel consumed by the engine 5 is constant at 0 or is constant at a value other than 0, or when a specified time passes after the engine 5 is stopped, the fuel supply device 1 performs "the current value learning or the number-of-revolutions learning" and "the map correction processing".

First, in step 81, the ECU 17 determines whether or not "the current value learning or the number-of-revolutions learning" is already performed. If the learning is already performed, the ECU 17 finishes the processing. If the learning is not yet performed, the routine proceeds to step 82.

In step 82, it is determined whether or not it is the time when the engine 5 is started. "The time when the engine 5 is started" means the time when the ECU 17 increases the pressure of the fuel from a state where the pressure of the fuel is 0. For example, as to a vehicle to start increasing the pressure of the fuel when an ignition key is turned on, the time when the ignition key is turned on corresponds to "the time when the engine 5 is started". Further, as to a vehicle to start increasing the pressure of the fuel when a driver touches a door of a vehicle, the time when the driver touches the door of the vehicle corresponds to "the time when the engine 5 is started".

In a case where the vehicle is at "the time when the engine 5 is started", "the current value learning or the number-of-revolutions learning" of step 4 and "the map correction processing" of step 5 are performed. In a case where the vehicle is not at "the time when the engine 5 is started", the routine proceeds to step 83.

In step 83, it is determined whether or not a fuel cutting flag is ON. If the fuel cutting flag is ON, the fuel flow rate Q required by the engine 5 is 0 and constant, so the routine proceeds to step 4 and step 5. If the fuel cutting flag is OFF, the routine proceeds to step 84.

In step 84, it is determined whether or not the flow rate of the fuel required by the engine 5 is at a constant value other than 0, that is, in "a steady state". "The steady state" corresponds to, for example, a state where a vehicle is subjected to a cruise control. If the engine is in "the steady state", the processings in steps 4 and 5 are performed, whereas if the engine is not in "the steady state", the routine proceeds to step 85.

In step 85, it is determined whether or not a specified time passes after the driving of the engine 5 is stopped. If a state where the engine 5 is stopped continues for a specified time, the processings in steps 4 and 5 are performed, whereas if the state where the engine 5 is stopped does not continue for a specified time, the routine is finished.

Figure 27:
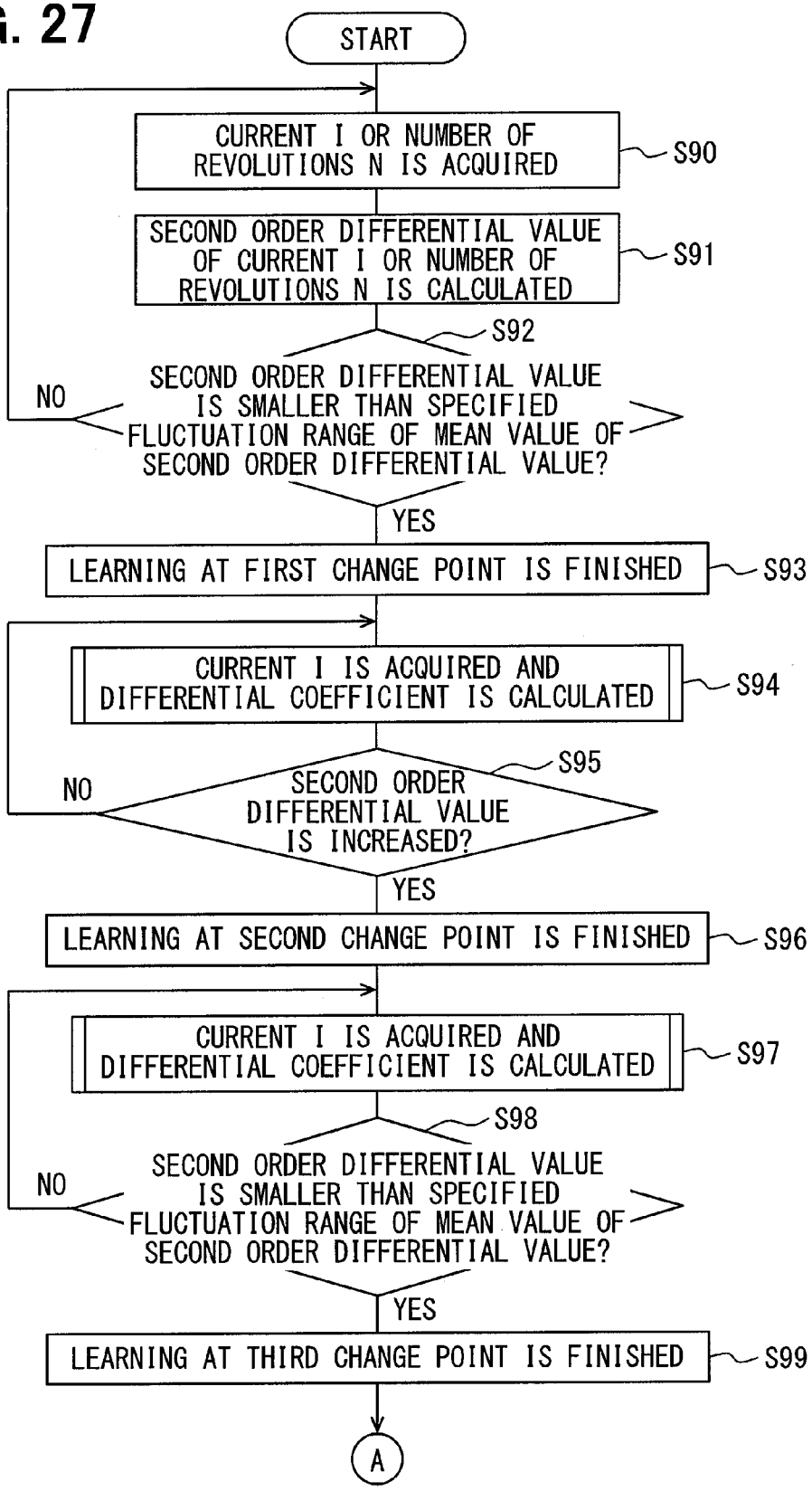
FIG. 27 is a flow chart of the current value learning or the number-of-revolutions learning.

Next, "the current value learning or the number-of-revolutions learning" performed by the fuel supply device 1 will be described with reference to FIG. 27. Here, in the following description, a case where the ECU 17 learns the current I will be described but, as shown in the flow chart of FIG. 27, the ECU 17 can learn also the number of revolutions N in place of the current I.

In "the current value learning or the number-of-revolutions learning", the ECU 17 "continuously drives" the fuel pump 3. Here, "continuously drives" means that the voltage applied to the motor 7 (ECU instructed Duty) is continuously increased at a specified rate for a specified time to thereby drive the fuel pump 3.

Here, when the ECU 17 "continuously drives" the fuel pump 3, the ECU 17 changes a relationship between an increase in the voltage applied to the motor 7 and time according to the condition of the engine 5 and controls time required for the sensing portion 19, the calculation portion 20, and the correction portion 21 to perform the processing.

For example, in a case where the ECU 17 "continuously drives" the fuel pump 3 at the time when the engine 5 is started, the ECU 17 controls a relationship between the voltage applied to the motor 7 and time in such a way that "the current value learning or the number-of-revolutions learning" can be performed within a period of time in which the engine is started and which is set for the vehicle.

Further, in a case where the ECU 17 "continuously drives" the fuel pump 3 when the fuel cutting flag is ON or when the engine is in the steady state, the ECU 17 increases the voltage applied to the motor 7 for a short time. This is because of the following reason: in this case, it is highly likely for the state to be changed by a driving condition, so it is desired to finish "the current value learning or the number-of-revolutions learning" in a short time.

Still further, in a case where the ECU 17 "continuously drives" the fuel pump 3 when a state where the engine is stopped continues for a specified time, the ECU 17 increases the voltage applied to the motor 7 for a comparatively long time. This is because of the following reason: in this case, the state is unlikely to be changed and hence "the current value learning or the number-of-revolutions learning" can be performed for the comparatively long time.

In step 90, the sensing portion 19 acquires the current I when the fuel pump 3 is "continuously driven" by the use of the output of the current sensor 23. At this time, the sensing portion 19 assumes that a period of time in which an inrush current is developed after the controller 22 starts to supply the voltage V and the current I to the motor 7 is a mask period and does not use a current value of the period of time so as to sense the first change point, the second change point, and the third change point.

Figure 24:
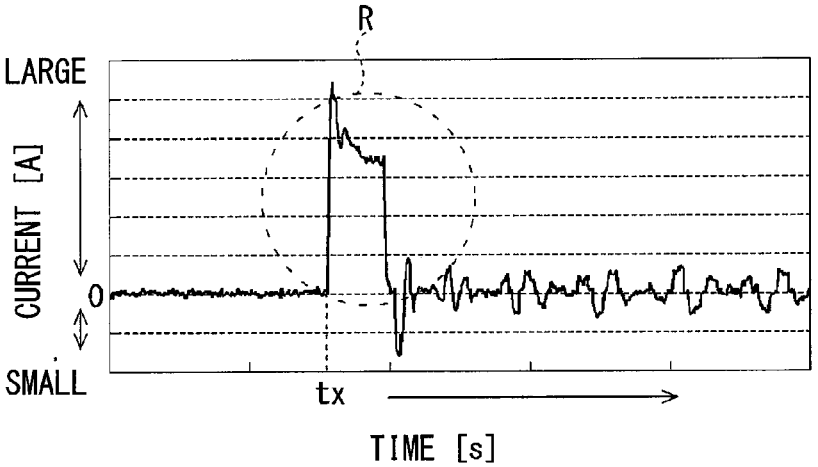
FIG. 24 is a graph to show a characteristic when a power supply to a motor of a fuel pump is started in a fuel supply device according to a sixth embodiment of the present invention.

Here, a current value immediately after starting to "continuously drive" the fuel pump 3 is shown in FIG. 24.

In FIG. 24, after a timing tx, the voltage V and the current I are supplied to the motor 7 from the controller 22. At that time, as shown by a broken line R, an inrush current is developed for a specified period of time immediately after the timing tx. For that reason, if the sensing portion 19 does not use a current value of this period of time so as to sense the change point, the sensing portion 19 can increase the accuracy of "the current value learning or the number-of-revolutions learning"

Next, in step 91, the sensing portion 19 calculates a second to order differential coefficient which is acquired by further differentiating the differential coefficient of the current I with respect to time.

Figure 25A:
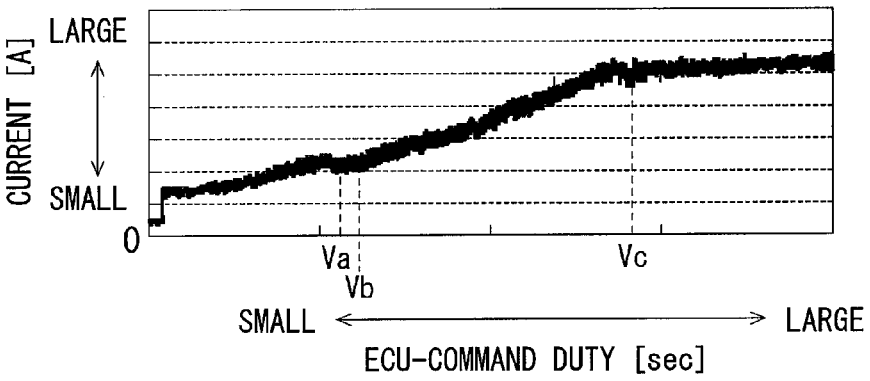
FIG. 25A is a graph to show a characteristic of current when the pump is continuously driven.
Figure 25B:
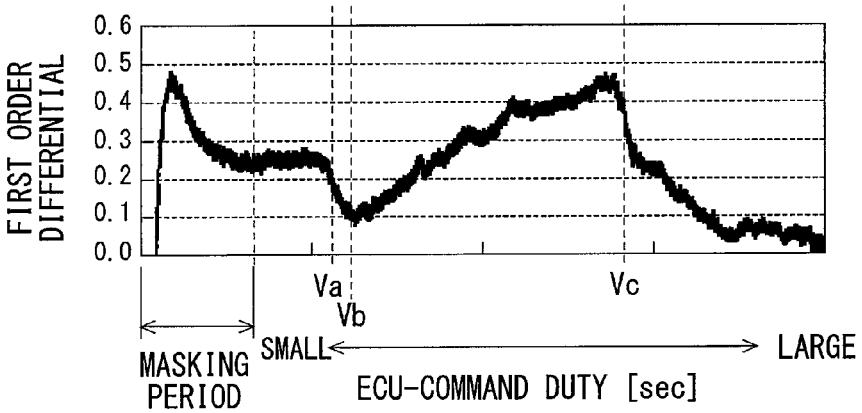
FIG. 25B is a graph to show a differential coefficient of current with respect to time when the pump is continuously driven.
Figure 25C:
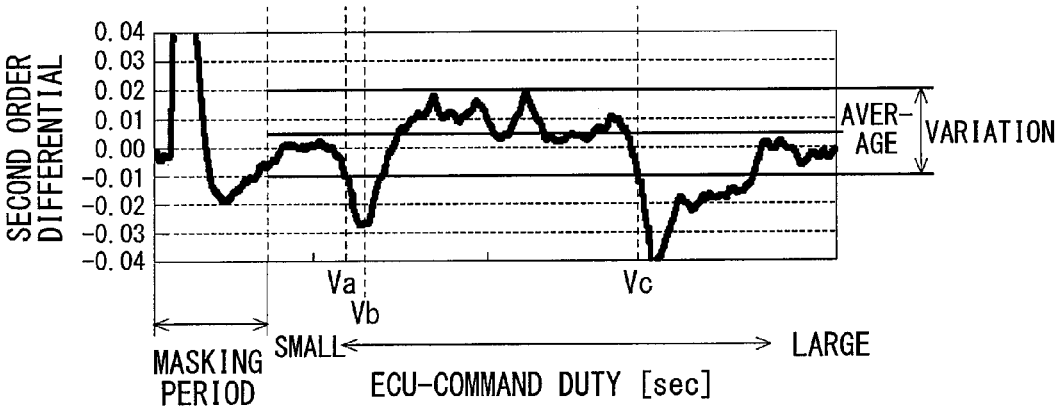
FIG. 25C is a graph to show a second order differential coefficient of current with respect to time when the pump is continuously driven.

Here, the characteristic of the current value at the time when the fuel pump 3 is continuously driven will be shown in FIG. 25A, a differential coefficient of the current value with respect to time will be shown in FIG. 25B, and a second order differential coefficient of the current value with respect to time will be shown in FIG. 25C.

As shown in FIG. 25C, the sensing portion 19 calculates a mean value of the second order differential coefficient and a specified fluctuation range (variation) with center at the mean value. As to the mean value and the specified fluctuation range, those calculated at the time of performing "the current value learning or the number-of-revolutions learning" last time may be used or those calculated at the time of performing "the current value learning or the number-of-revolutions learning" for a plurality of times in the past may be used.

In this regard, as described above, the sensing portion 19 assumes that the period of time in which the inrush current is developed after the controller 22 starts to apply the voltage to the motor 7 is the masking period and does not use the current during the masking period so as to sense the change point. In other words, the sensing portion 19 uses the current value sensed after the masking period passes so as to calculate the mean value and the fluctuation range of the second order differential coefficient.

Subsequently, in step 92, the sensing portion 19 determines whether or not the second order differential coefficient is smaller than a specified fluctuation range.

The sensing portion 19 determines a first falling point at which the second order differential coefficient becomes smaller than the specified fluctuation range as being a first change point caused by the regulator valve 13 being opened. In FIG. 25C, the first change point is designated by Va.

In step 93, the sensing portion 19 learns a voltage Va (ECU instructed Duty) at the first change point and stores the voltage Va in the storage portion 18.

In step 94, the sensing portion 19 performs the same processing as in steps 90, 91.

In step 95, the sensing portion 19 determines whether or not the second order differential coefficient is increased. After the sensing portion 19 determines the first falling point, the sensing portion 19 determines a rising point at which the second order differential coefficient increases as being a second change point caused by the jet pump 16 starting to regulate a flow rate. In FIG. 25C, the second change point is designated by Vb.

In step 96, the sensing portion 19 learns a voltage Vb (ECU instructed Duty) at the second change point and stores the voltage Vb in the storage portion 18.

In step 97, the sensing portion 19 performs the same processing as in steps 90, 91.

In step 98, the sensing portion 19 determines whether or not the second order differential coefficient is smaller than a specified fluctuation range.

The sensing portion 19 determines a second falling point at which the second order differential coefficient becomes smaller than the specified fluctuation range as being a third change point caused by the relief valve 14 being opened. In FIG. 25C, the third change point is designated by Vc.

In step 99, the sensing portion 19 learns a voltage Vc (ECU instructed Duty) at the third change point and stores the voltage Vc in the storage portion 18.

Subsequently, as described in the first embodiment, the ECU 17 performs "the map correction processing". In this regard, the ECU 17 may perform "the current value learning or the number-of-revolutions learning" for a plurality of times in steps 82 to 85 to thereby increase the sensing accuracy of the voltages Va, Vb, Vc at the first, second, third change points and then may perform "the map correction processing".

The sixth embodiment produces the operation and effect to be described below. (1) In the sixth embodiment, the sensing portion 19 does not use the current value supplied to the motor 7 from the controller 22 so as to perform "the current value learning or the number-of-revolutions learning" for the period of time in which the inrush current is developed.

In this way, the sensing portion 19 can increase the accuracy of "the current value learning or the number-of-revolutions learning".

(2) In the sixth embodiment, when the engine 5 is started, when the flow rate of the fuel required by the engine 5 is constant at 0 or constant at a value other than 0, or after a specified time passes after the engine 5 is stopped, the sensing portion 19, the calculation portion 20, and the correction portion 21 perform the processing.

In this way, "the current value learning or the number-of-revolutions learning" can be performed in various states of the engine 5, so the sensing accuracy can be increased.

(3) In the sixth embodiment, when the controller 22 continuously drives the fuel pump 3, the controller 22 changes the relationship among the voltage and the current, which are supplied to the motor 7, and the time according to the condition of the engine 5 to thereby control the time required for the sensing portion 19, the calculation portion 20, and the correction portion 21 to perform the processing.

In this way, it is possible to prevent the processing from being stopped while "the current value learning or the number-of-revolutions learning" is performed.

(4) In the sixth embodiment, the sensing portion 19 senses the first, the second, and the third change points by the use of the second order differential coefficient.

In this way, it is possible to further increase the sensing accuracy in comparison to the sensing accuracy acquired when the first, the second, and the third change points are sensed by the use of the first order differential coefficient.

(5) In the sixth embodiment, when the second order differential coefficient is more than a specified fluctuation range with center at the mean value of the second order differential coefficient, the sensing portion 19 determines the first and the third change points.

In this way, the ECU 17 can calculate a fluctuation range, which becomes a criterion for determination of the first and the third change points, by itself. Hence, as compared with a case where the first and the third change points are determined by the threshold value, a process of storing the threshold value corresponding to the vehicle in the ECU 17 can be eliminated. Hence, it is possible to simplify a manufacturing process.

Other Embodiments

In the sixth embodiment described above, when the second order differential coefficient is more than the specified fluctuation range, the ECU determines the first and the third change points. In contrast to this, it is also recommended to store a specified second threshold value in the storage portion in advance and to make the ECU determine the first and the third change points when the second order differential coefficient is more than the second threshold value.

Here, the present disclosure is not limited to the embodiments described above but can be performed not only by combining the plurality of embodiments described above with each other but also in various modes within a scope not departing from the gist of the invention.

The invention claimed is:

1. A fuel supply device for supplying an engine with fuel sucked up from a fuel tank, the fuel supply device comprising:

a fuel pump for sucking up the fuel from the fuel tank by rotation of a motor;

a valve that is provided in a fuel passage for supplying the engine with the fuel sucked up by the fuel pump and that is opened when the fuel flowing in the fuel passage reaches a specified pressure to thereby discharge the fuel from the fuel passage;

a storage portion for storing a relationship among a fuel pressure, a flow rate, which are required by the engine, and voltage and current which are supplied to the motor;

a controller configured to supply the motor with the voltage and the current based on the relationship stored in the storage portion;

a sensing portion for sensing the voltage and current, which is supplied to the motor by the controller when the valve is opened at a change point wherein a characteristic of the current and the voltage, which are supplied to the motor, is changed at a specified flow rate required by the engine;

a calculation portion for calculating a difference between the voltage and the current which are stored in the storage portion in correspondence to a valve opening voltage, and the voltage and the current which are sensed by the sensing portion when the valve is opened; and a correction portion for correcting the voltage and the current, which are stored in the storage portion, on the basis of the differences calculated by the calculation portion.

2. A fuel supply device as claimed in claim 1, further comprising:

an orifice for regulating a flow rate of the fuel discharged from the valve, wherein the sensing portion senses the voltage and the current, which is supplied to the motor by the controller when the orifice starts to regulate the flow rate at a second change point wherein the characteristic of the current and the voltage, which are supplied to the motor is changed, at the current and the voltage, which is higher than those at the change point, wherein the calculation portion calculates a difference between the voltage and the current, which are stored in the storage portion in correspondence to a fuel pressure corresponding to a flow rate regulation of the orifice, and the voltage and the current when the valve is opened at the second change point which are sensed by the sensing portion, and wherein the correction portion linearly corrects the voltage and the current, which are stored in the storage portion, on the basis of the differences at the change point and the differences at the second change point which are calculated by the calculation portion.

3. A fuel supply device as claimed in claim 1, further comprising:

a second valve that is provided in the fuel passage and that is opened at a fuel pressure different from the valve to thereby discharge the fuel from the fuel passage;

wherein the sensing portion senses the voltage and the current, which is supplied to the motor by the controller when the second valve is opened at a third change point wherein a characteristic of the current and the voltage, which are supplied to the motor, is changed, at current and voltage, which are different from the change point or a second change point, wherein the calculation portion calculates a difference between the voltage and the current, which are stored in the storage portion in correspondence to a valve opening pressure of the second valve, and the voltage and the current when the second valve is opened at the third change point which is sensed by the sensing portion, and wherein the correction portion linearly corrects the voltage and the current, which are stored in the storage portion, on the basis of the differences at the change point and the differences at the third change point which are calculated by the calculation portion.

4. A fuel supply device as claimed in claim 1, wherein the sensing portion does not use the current supplied to the motor from the controller so as to sense the change point for a period of time in which an inrush current is developed after the controller starts to supply the motor with electricity.

5. A fuel supply device as claimed in claim 1, wherein the sensing portion, the calculation portion, and the correction portion perform their processings when the engine is started, when a flow rate of the fuel required by the engine is constant at a value of 0 or is constant at a value other than 0, or after a specified time passes after the engine is stopped.

6. A fuel supply device as claimed in claim 5, wherein the controller changes a relationship among the voltage and the current supplied to the motor and time according to a condition of the engine, thereby regulating time necessary for the sensing portion, the calculation portion, and the correction portion to perform their processings.

7. A fuel supply device as claimed in claim 1, wherein when the controller changes the voltage supplied to the motor at a specified rate for a specified time, the sensing portion calculates a differential coefficient of the current with respect to the time and senses the change point by the use of the differential coefficient.

8. A fuel supply device as claimed in claim 1, wherein when the controller changes the voltage supplied to the motor at a specified rate for a specified time, the sensing portion calculates a differential coefficient of a number of revolutions of the motor with respect to the time and senses the change point by the use of the differential coefficient.

9. A fuel supply device as claimed in claim 1, wherein when the controller changes the current supplied to the motor at a specified rate for a specified time, the sensing portion calculates a differential coefficient of a number of revolutions of the motor with respect to the time and senses the change point by the use of the differential coefficient.

10. A fuel supply device as claimed in claim 1, wherein when the controller changes a number of revolutions of the motor at a specified rate for a specified time, the sensing portion calculates a differential coefficient of the voltage or the current with respect to the time and senses the change point by the use of the differential coefficient.

11. A fuel supply device as claimed in claim 1, wherein when the controller changes the voltage and the current, which are supplied to the motor, at a specified rate for a specified time, the sensing portion calculates a second order differential coefficient acquired by further differentiating a differential coefficient of the voltage or the current with respect to the time and senses the change point by the use of the second order differential coefficient.

12. A fuel supply device as claimed in claim 11, wherein when the second order differential coefficient is larger than a specified fluctuation range with center at a mean value of the second order differential coefficient, the sensing portion senses the change point.

13. A fuel supply device as claimed in claim 1, wherein when the controller changes the voltage and the current, which are supplied to the motor, at a specified rate for a specified time, the sensing portion calculates a differential coefficient of the voltage or the current with respect to the time, and wherein when the differential coefficient is larger than a specified threshold value, the sensing portion senses the change point.

14. A fuel supply device as claimed in claim 11, wherein when the second order differential coefficient is larger than a second threshold value, the sensing portion senses the change point.

15. A fuel supply device as claimed in claim 1, further comprising:

a sensor capable of sensing that the valve is opened, wherein when a signal is outputted from the sensor, the sensing portion senses the change point.

* * * * *